US008567749B2

(12) United States Patent
Pantano

(10) Patent No.: US 8,567,749 B2
(45) Date of Patent: Oct. 29, 2013

(54) SILL OR HOB MOULDING SYSTEM

(71) Applicant: Antonio Pantano, Heidelberg West (AU)

(72) Inventor: Antonio Pantano, Heidelberg West (AU)

(73) Assignee: Pantano Investments PTY Ltd, West Heidelberg Vic (AU)

( * ) Notice: Subject to any disclaimer, the term of this patent is extended or adjusted under 35 U.S.C. 154(b) by 0 days.

(21) Appl. No.: 13/727,812

(22) Filed: Dec. 27, 2012

(65) Prior Publication Data

US 2013/0112847 A1 May 9, 2013

Related U.S. Application Data

(63) Continuation of application No. PCT/AU2011/000792, filed on Jun. 28, 2011.

(51) Int. Cl.
*E04G 11/36* (2006.01)

(52) U.S. Cl.
USPC ..... 249/18

(58) Field of Classification Search
CPC ..... E04G 11/06; E04G 11/36
USPC ..... 249/34, 13, 18
See application file for complete search history.

(56) References Cited

U.S. PATENT DOCUMENTS

| | | | | | |
|---|---|---|---|---|---|
| 940,463 | A | * | 11/1909 | Kay | 249/34 |
| 1,527,551 | A | * | 2/1925 | Hollis | 249/15 |
| 2,021,210 | A | * | 11/1935 | Thorn | 249/1 |
| 2,250,064 | A | * | 7/1941 | Jorsch | 249/34 |
| 2,251,775 | A | * | 8/1941 | Arrighini | 249/34 |
| 2,289,819 | A | * | 7/1942 | Wirtane | 249/34 |
| 3,171,185 | A | * | 3/1965 | Anderson | 249/34 |
| 3,405,905 | A | * | 10/1968 | Dakin | 249/40 |
| 3,722,849 | A | * | 3/1973 | Luyben | 249/219.1 |
| 4,186,160 | A | * | 1/1980 | Landreth | 264/34 |
| 4,366,657 | A | * | 1/1983 | Hopman | 52/405.1 |
| 4,678,156 | A | * | 7/1987 | Scalamandre et al. | 249/34 |
| 5,207,931 | A | * | 5/1993 | Porter | 249/210 |
| 5,511,761 | A | * | 4/1996 | Schultz | 249/34 |

(Continued)

FOREIGN PATENT DOCUMENTS

| | | |
|---|---|---|
| AU | 2004100510 | 7/2004 |
| EP | 1936038 | 6/2008 |
| KR | 20050007840 | 1/2005 |

OTHER PUBLICATIONS

PCT Preliminary Examination Report, Mar. 22, 2012, PCT/AU2011/000792.

*Primary Examiner* — Michael Safavi
(74) *Attorney, Agent, or Firm* — Michael S. Neustel

(57) ABSTRACT

An elongated hollow mould for the integral formation of a raised sill or hob on the surface of a cast-in-situ concrete building slab, said mould comprising two generally parallel, continuous side panels joined in fixed spatial relationship at their upper and lower edges by spacer elements which permit the entry of concrete from above and the passage of concrete there through to formwork below upon which said slab is to be formed, thereby making the concrete within said filled mould contiguous with that of said concrete slab beneath; said mould being supported upon a plurality of discrete chairs, each said chair comprising two narrow, parallel, vertically oriented side panels joined at their lower ends by a transverse bottom part fixed to said formwork, said mould being supported in a said chair by a height-adjustable transverse bridge fixed to said chair side panels.

46 Claims, 14 Drawing Sheets

(56) References Cited

U.S. PATENT DOCUMENTS

| | | | | | |
|---|---|---|---|---|---|
| 5,882,540 | A * | 3/1999 | Farrington | 249/34 |
| 5,922,236 | A * | 7/1999 | Zuhl | 249/34 |
| 6,016,633 | A * | 1/2000 | Elwart | 52/294 |
| 6,158,710 | A * | 12/2000 | Matthews | 249/34 |
| 6,332,599 | B1 * | 12/2001 | Spartz | 249/34 |
| 7,775,499 | B2 * | 8/2010 | Metcalf | 249/34 |
| 8,348,224 | B2 * | 1/2013 | McDonagh | 249/216 |

* cited by examiner

Fig 2
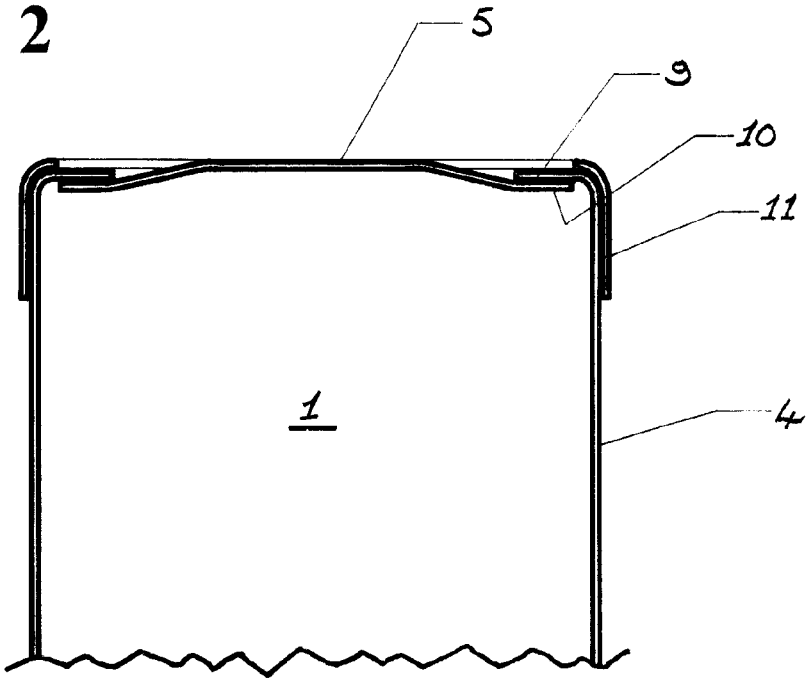
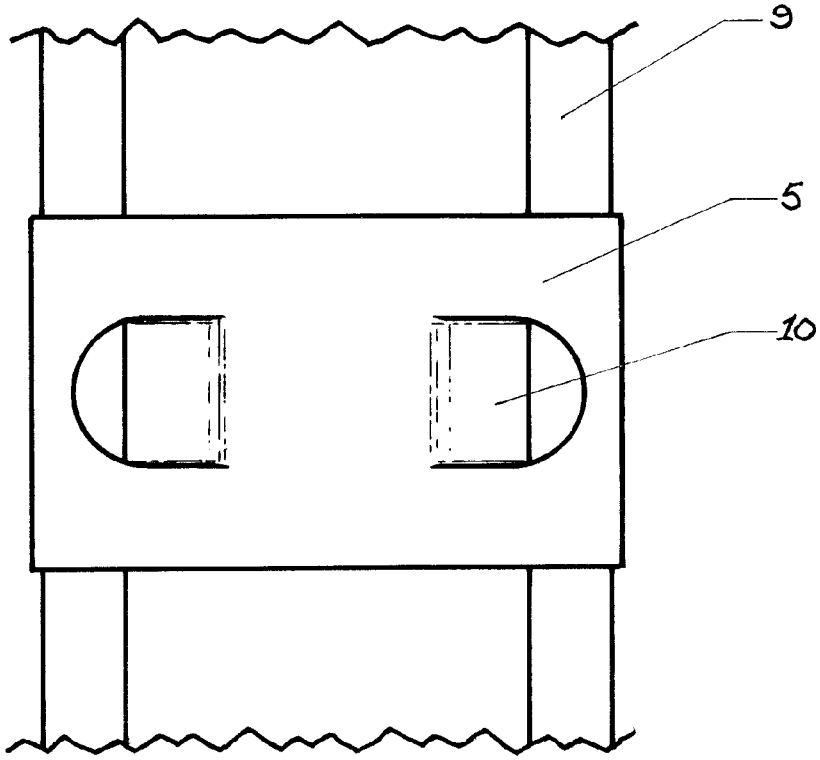
Fig 3

Fig 4
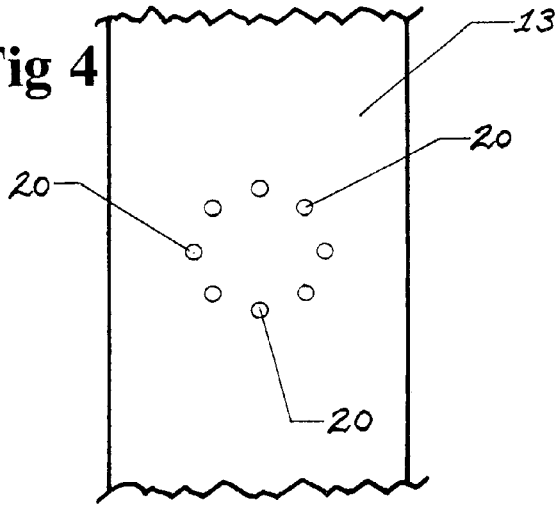
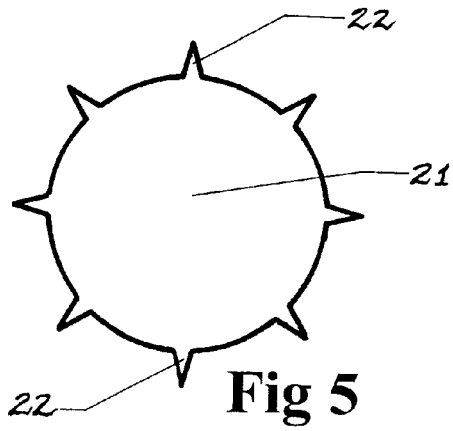
Fig 5
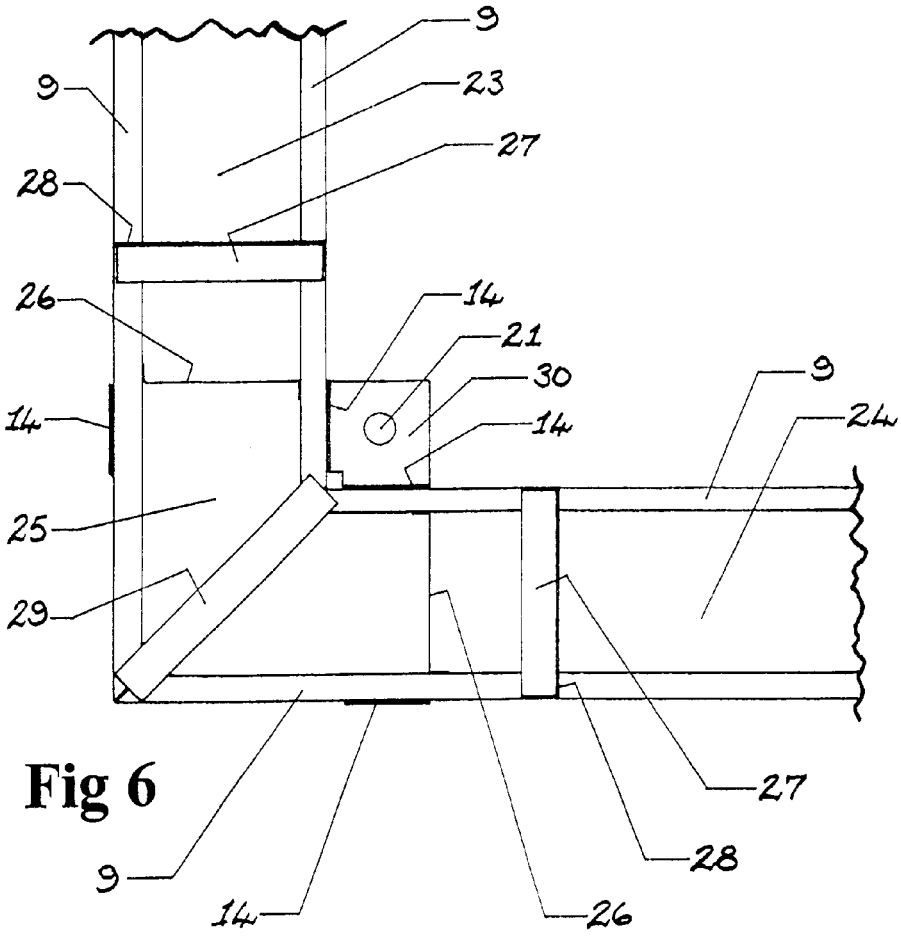
Fig 6

Fig 8
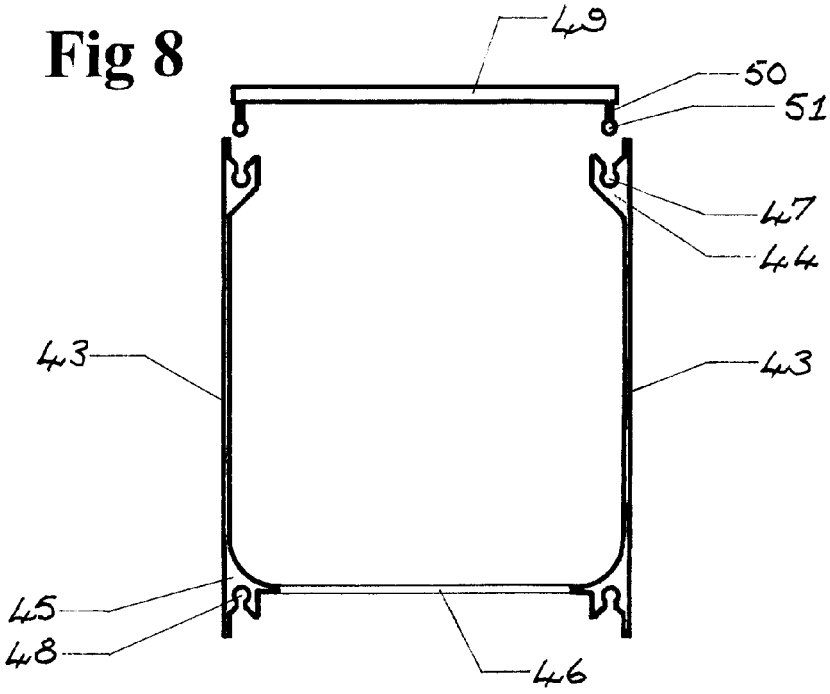
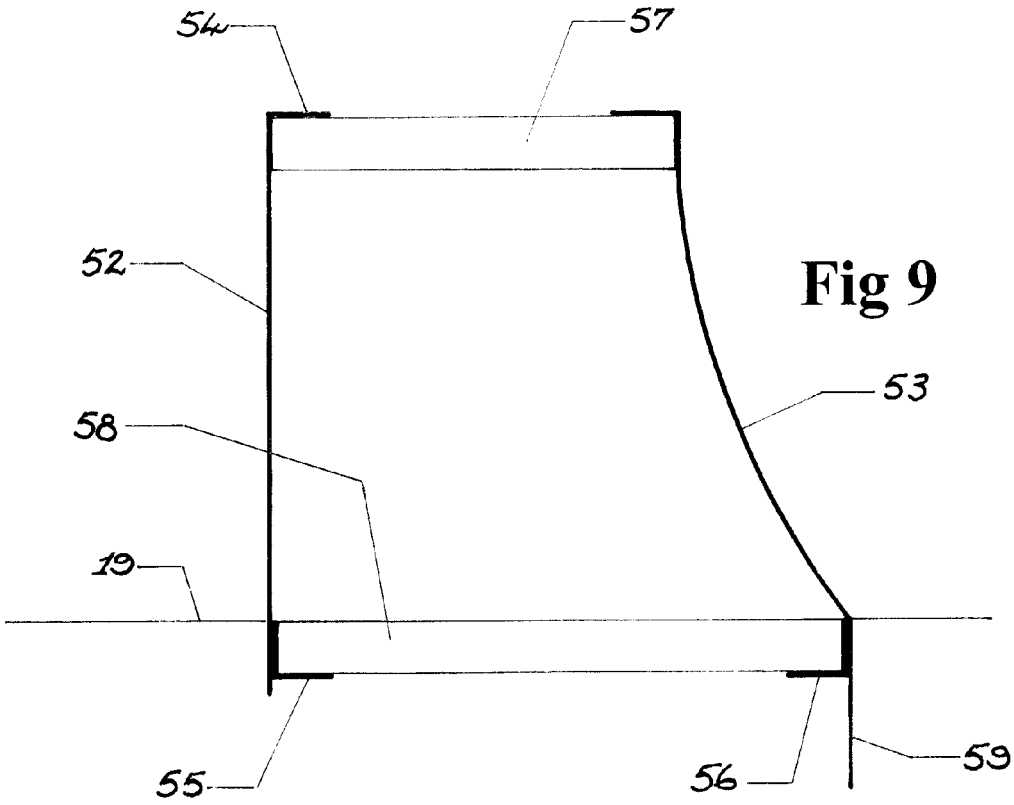
Fig 9

Fig 16
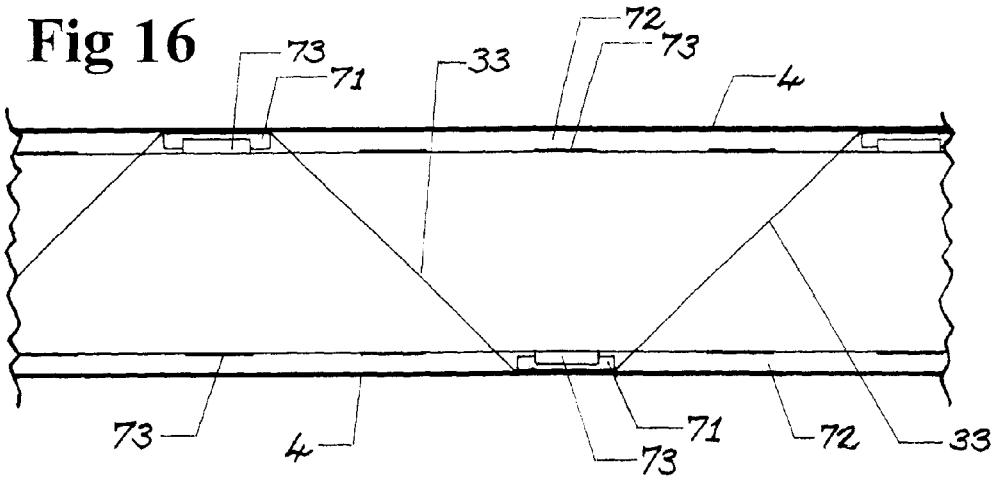
Fig 17
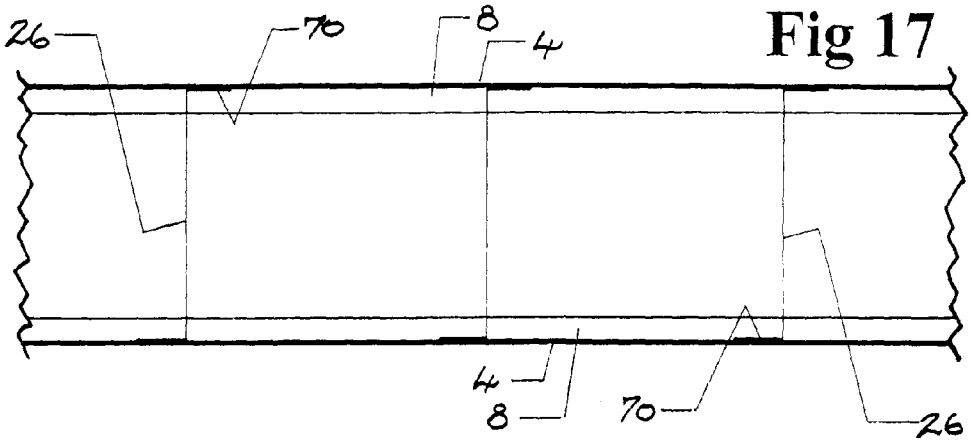
Fig 18
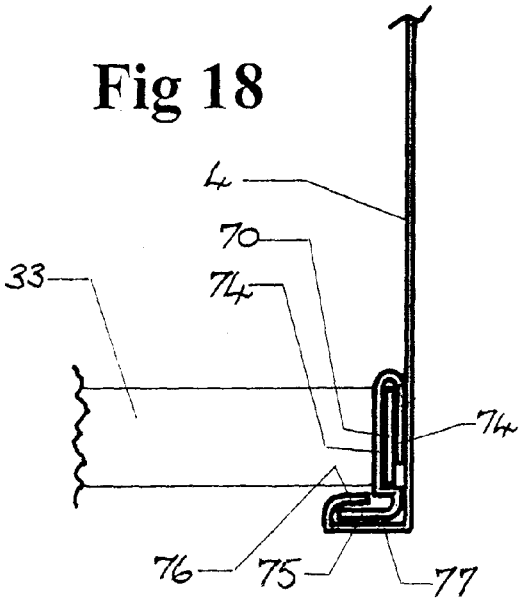
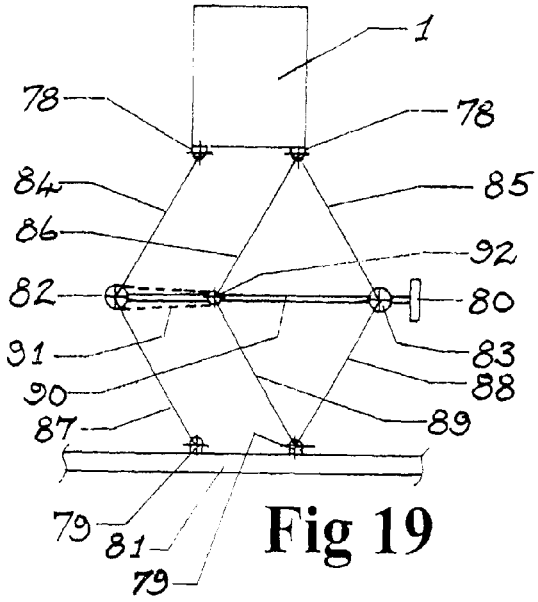
Fig 19

Fig 20
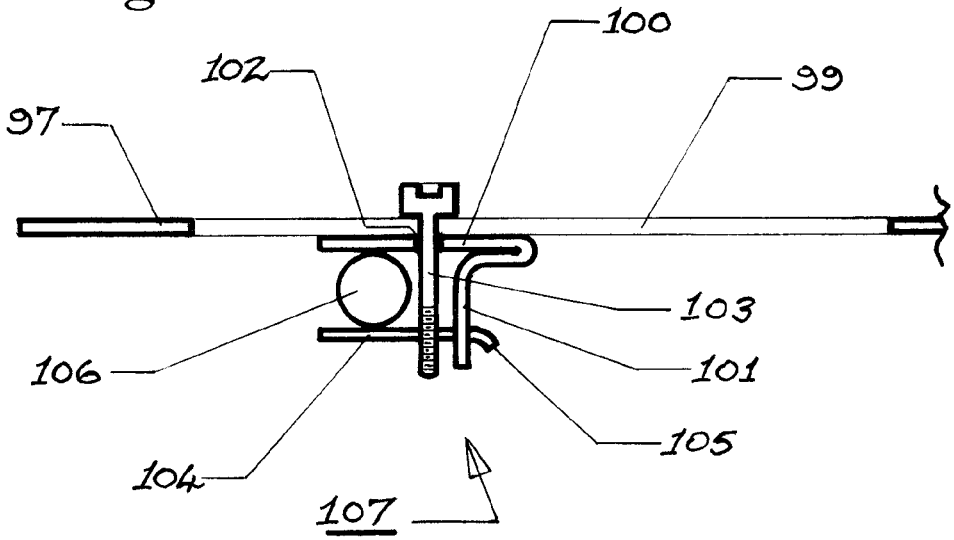
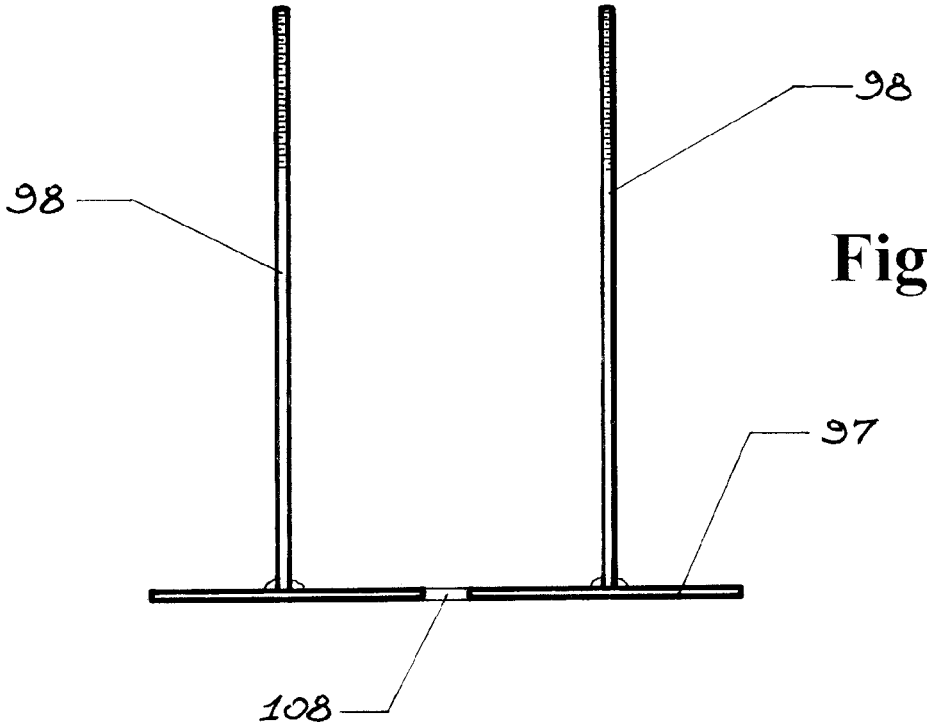
Fig 21

Fig 22
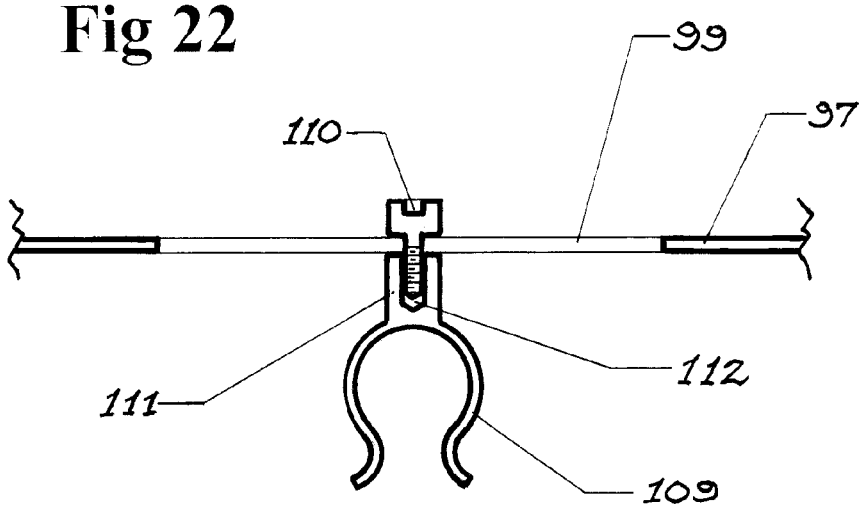
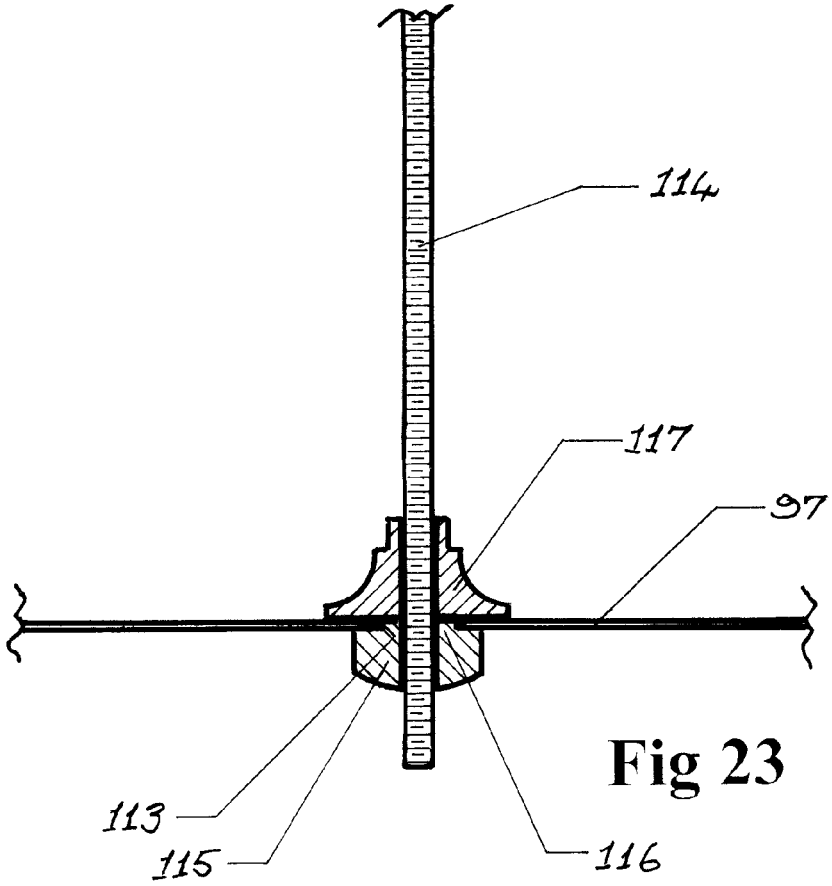
Fig 23

Fig 24
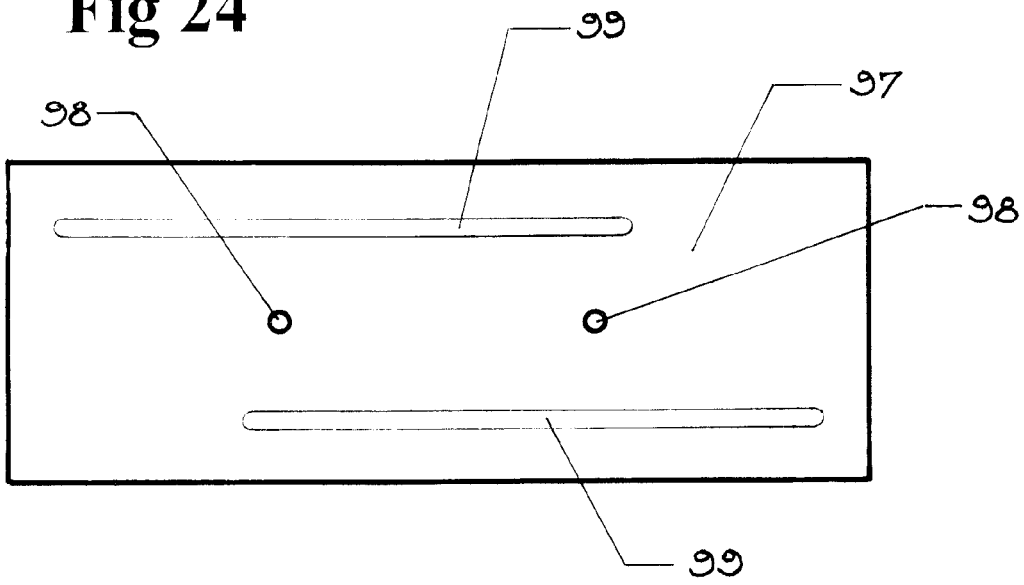
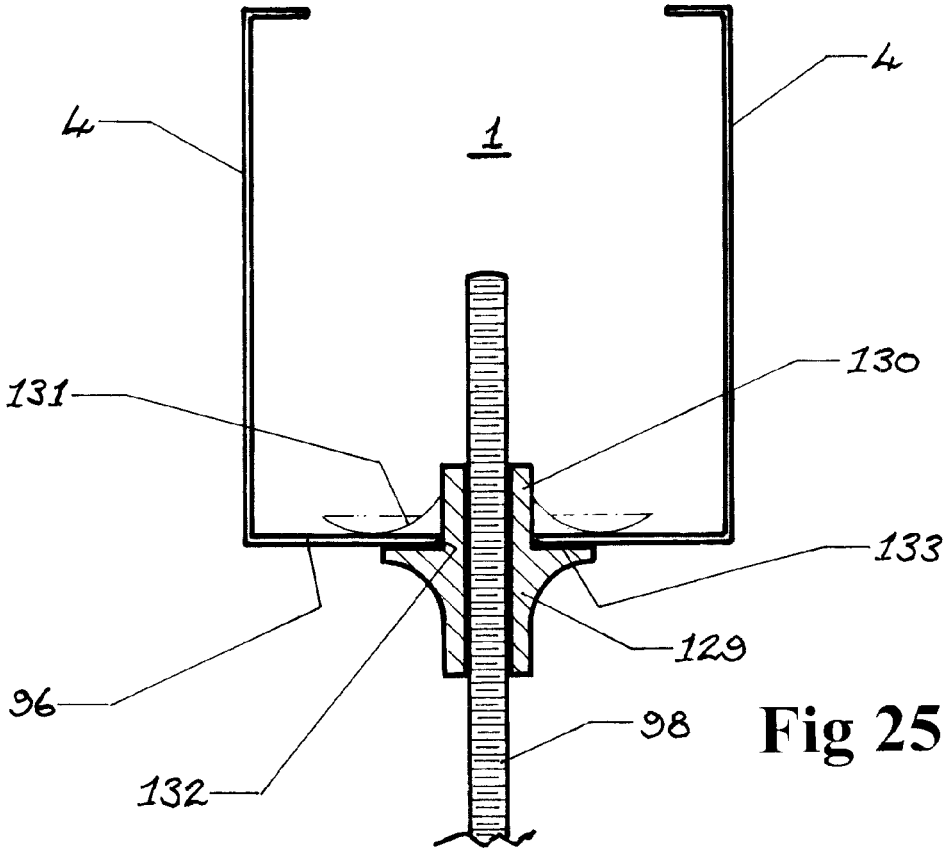
Fig 25

Fig 26
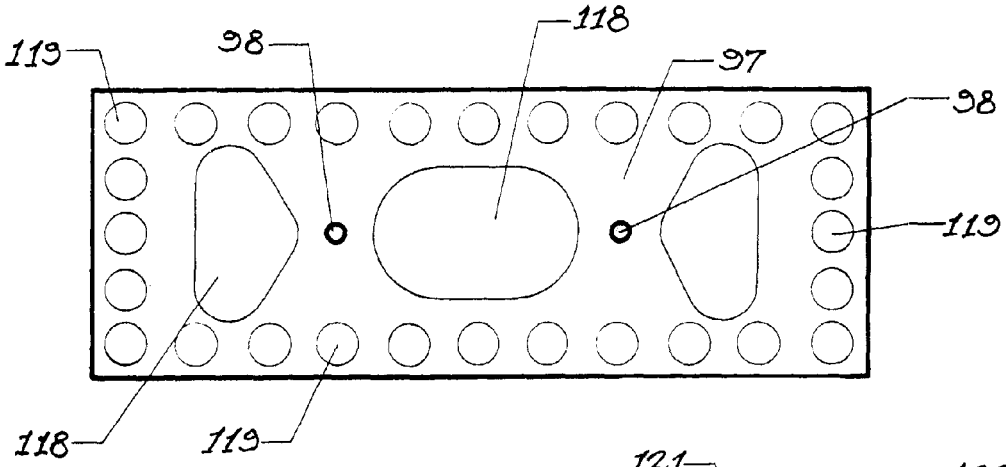
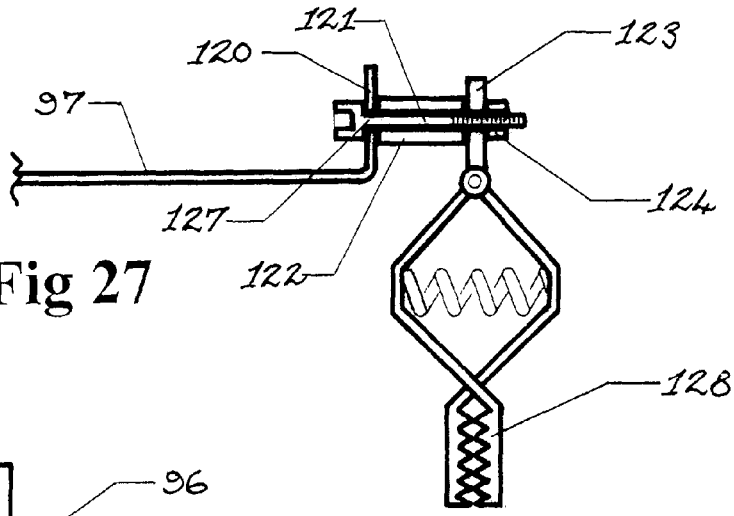
Fig 27
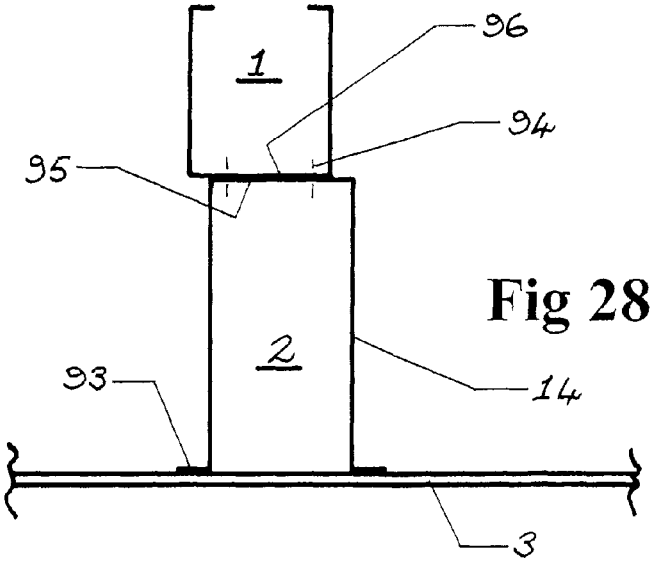
Fig 28

Fig 30
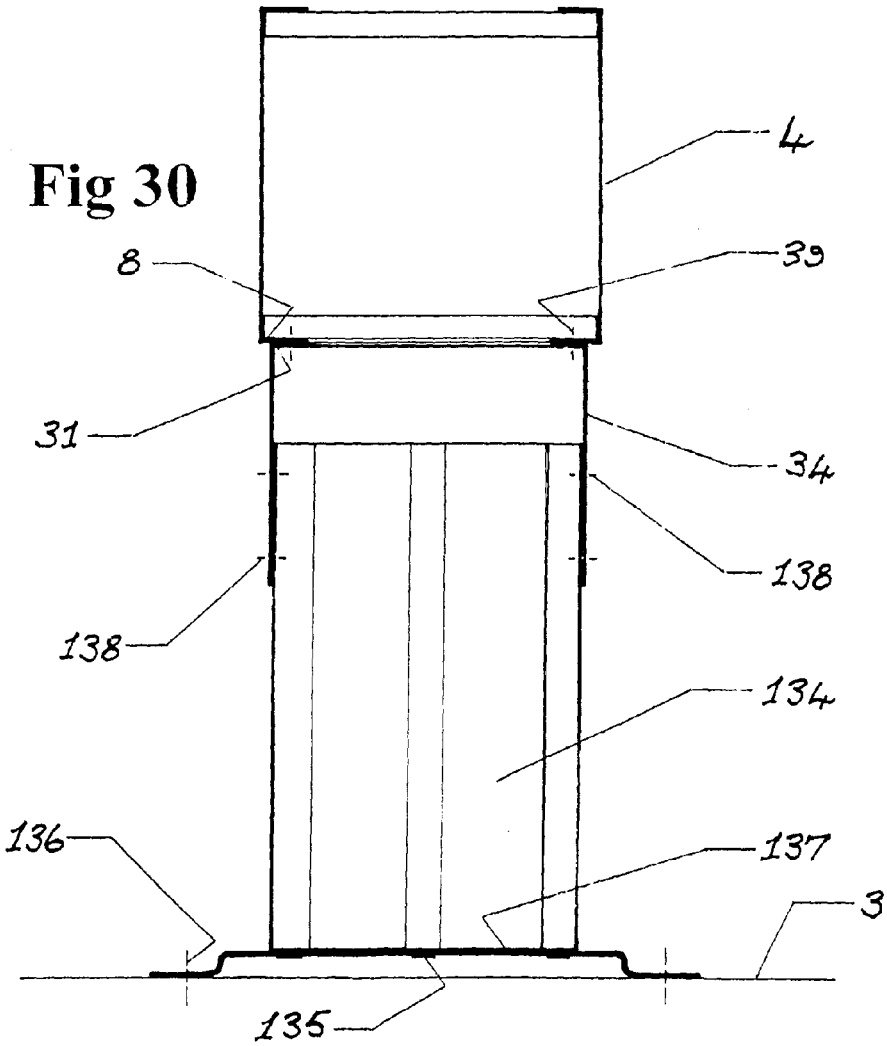
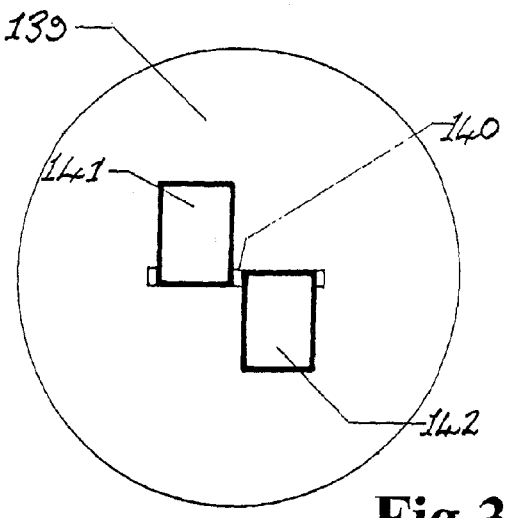
Fig 31
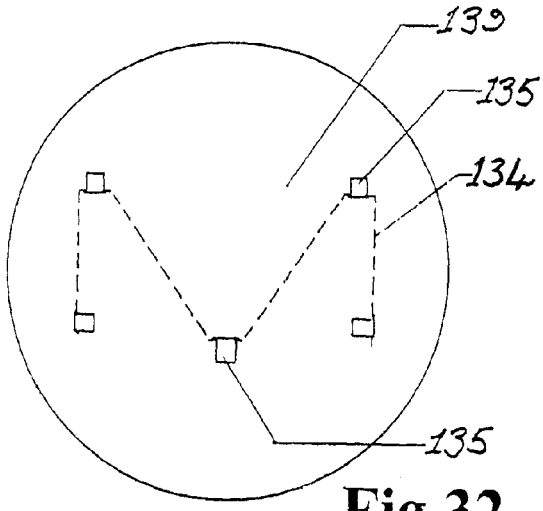
Fig 32

SILL OR HOB MOULDING SYSTEM

CROSS REFERENCE TO RELATED APPLICATIONS

This application is a continuation of International Application No. PCT/AU2011/000792, filed Jun. 28, 2011, which claims priority to Australian Application No. AU2010902877, filed Jun. 29, 2010. This application claims priority to both International Application No. PCT/AU2011/000792 and Australian Application No. AU2010902877. The PCT/AU2011/000792 application and the AU2010902877 are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

This invention relates generally to the provision, as part of the building construction process, of sills or hobs for the fixing of windows, curtain walls and the like to cast-in-situ concrete slabs. More particularly, it relates to moulds for the casting of such sills or hobs onto or integrally with cast in-situ concrete building slabs.

2. Description of the Related Art

Any discussion of the related art throughout the specification should in no way be considered as an admission that such related art is widely known or forms part of common general knowledge in the field.

Particularly in the construction of multi-story buildings, it is common to provide raised sills or hobs of some form to cast in-situ concrete slabs. Such sills or hobs act as supports for building elements such as window frames, curtain wall panels and the like, providing a watertight barrier beneath such building elements to prevent the ingress of rain water and condensation. Said building elements may incorporate lower frames or sills that bear directly upon and are sealed to a supporting surface such as a cast in-situ concrete slab. These commonly take the form of simple or complex metal sections or solid timber sections. In other applications, separate sills or hobs of similar form are sealing fixed to a said supporting surface and said building elements are fixed to and supported by said sills or hobs. In yet other applications, concrete sills or hobs are formed on said cast in-situ concrete slabs to support said window frames, curtain wall panels and the like. In these applications, long box moulds which are more or less open at the top and bottom are fixed in appropriate positions to concrete slabs, filled with concrete and the concrete allowed to cure. Said sills or hobs are then waterproofed appropriately and said building elements then fixed to them. The separate forming of said sills or hobs on cast in-situ concrete slabs is inefficient and time consuming, requiring the re-attendance of several building trades personnel to a building site to accurately measure up and fix said moulds in position and then to fill them with concrete. Additionally, irregularities in the trowelled surfaces of said cast in-situ concrete slabs may require the removal of concrete in order for said moulds to be set at the correct level. When it is considered that a multi-story building may require several thousand lineal meters of such sills or hobs, the magnitude of the inefficiency and loss of time will be appreciated.

BRIEF SUMMARY OF THE INVENTION

The object of the present invention is to provide a system that permits the installation of sills or hob moulds to be integrated into the process of fixing steel reinforcement preliminary to the pouring of concrete slabs, and the filling said sill or hob moulds to be integrated into the process of in-situ casting of concrete building slabs.

According to the present invention, sill or hob moulds in the form of long boxes more or less open at the top and bottom are installed during the process of installing reinforcing bar. Said moulds are supported from formwork upon chairs which permit the height of said moulds to be adjusted such that their lower edges are set at the surface level of the finally cast slab. Fabricated short mould sections are used to join straight runs of said moulds end to end and at directional changes through angles of 90°, 45° or angles of other magnitude. During casting of the parent concrete building slab, said moulds are simultaneously filled with concrete and trowelled off to a level surface. The concrete of the sill or hob so created is thus integral with that of said concrete building slab and is thus much less prone to water infiltration. Various methods are provided to positively prevent water infiltration. Said moulds are made in a variety of cross-sectional shapes and different methods are provided for attaching them to said chairs and adjusting their heights. Provision is made for said sill or hob moulds to be made regularly curved to different radii or in other irregular alignments.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 2 is a fragmentary transverse cross-sectional view of the upper part of one embodiment of said sill or hob mould.

FIG. 3 is a view from above of said sill or hob mould of FIG. 2.

FIG. 4 is a fragmentary view from above of one embodiment of the transverse bottom part of a chair of the present invention.

FIG. 5 is a fixing disk employed with chairs of the embodiment depicted in FIG. 4.

FIG. 6 is a view from above of a 90° corner join straight runs of said sill or hob mould.

FIG. 8 is a transverse cross-sectional view of an embodiment of said sill or hob mould intended to be extruded in continuous lengths from a suitable thermoplastic polymer or light metal alloy material.

FIG. 9 is a transverse cross-sectional view of an embodiment of said sill or hob mould made with an asymmetric shape.

FIG. 16 is a fragmentary view from above of one embodiment of spacers inserted between side panels of said sill or hob moulds.

FIG. 17 is a fragmentary view from above of another embodiment of spacers inserted between side panels of said sill or hob moulds.

FIG. 18 is a fragmentary transverse cross-sectional view of means to join spacers to side panels of said sill or hob moulds.

FIG. 19 is a side view in skeletal form of an embodiment of a chair to support said sill or hob moulds which permits precise height adjustment.

FIG. 20 is a fragmentary, transverse cross-sectional view of clamping means to attach a chair to reinforcing bar.

FIG. 21 is a transverse cross-sectional view of an alternative embodiment of chair comprising threaded rods supported from a base plate.

FIG. 22 is a fragmentary, transverse cross-sectional view of an alternative embodiment of clamping means to attach a chair to reinforcing bar.

FIG. 23 is a fragmentary, transverse cross-sectional view of alternative means of attaching a threaded rod of a chair to its supporting base plate.

FIG. 24 is a view from above of an embodiment of the plate of a rod and plate-type chair.

FIG. 25 is a fragmentary transverse cross-sectional view of adjustable means to fix said sill or hob mould to the rods of a rod and plate-type chair.

FIG. 26 is a view from above of an alternative embodiment of rod and plate-type chair.

FIG. 27 is a fragmentary, transverse cross-sectional view of an alternative embodiment of clamping means to attach a chair to reinforcing bar.

FIG. 28 is a fragmentary, transverse cross-sectional view of means allowing lateral positional adjustment in fixing said sill or hob mould to a chair.

FIG. 30 is a transverse cross-sectional view of a chair incorporating the section of FIG. 29*d* to support a sill or hob mould at an of adjustable height.

FIG. 31 is a face view of a bifurcated attachment tab arrangement.

FIG. 32 is a face view of the reverse side of a base plate or sill or hob mould at the point of attachment of a chair incorporating the section of FIG. 29*d*.

The various figures are drawn to different scales and no inference should be drawn from this.

DETAILED DESCRIPTION OF THE INVENTION

Figure 1:
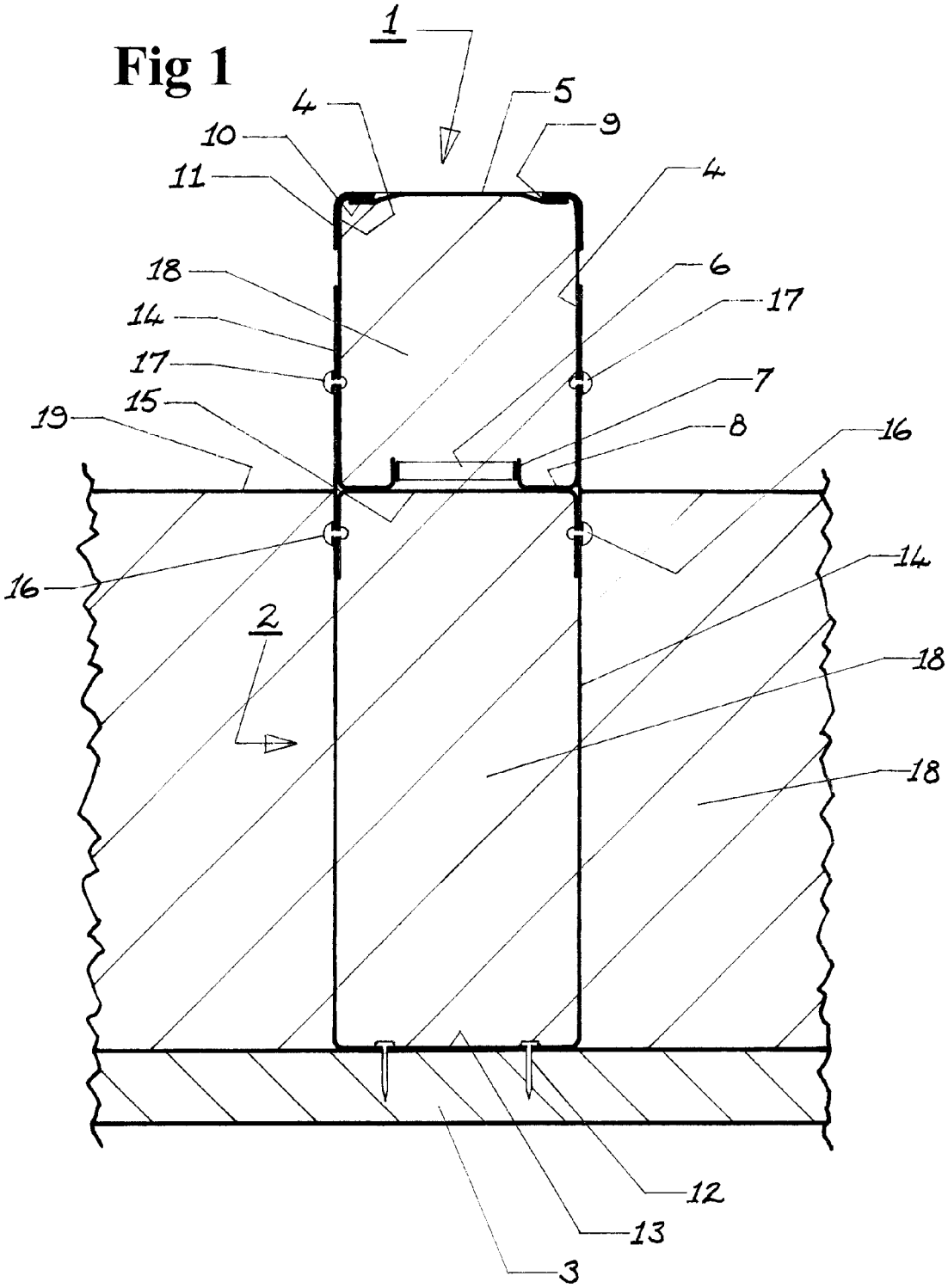
FIG. 1 is a transverse cross-sectional view of a sill or hob mould supported on a chair fixed to formwork, the mould filled with concrete and the concrete building slab cast beneath it.

With reference to FIGS. 1, 2 and 3, sill or hob mould 1 is supported upon chair 2 which is, in turn, fixed to formwork 3. Said sill or hob mould comprises side panels 4 joined in spatial relationship at their upper edges by a plurality of spacer clips 5. Said side panels are joined in fixed spatial relationship at their lower edges by spacer piece 6 being tack-welded to upstanding flanges 7 formed on lower transverse flanges 8. Conveniently, said spacer piece takes the form of a short section cut from a continuous length of rectangular tube section. With additional reference to FIGS. 2 and 3, the upper edges of said side panels are turned through 90° to create upper transverse flanges 9 which are engaged by tabs 10 of said spacer clips to retain said clips in position. Said upper edges of said side panels are maintained in spatial relationship by their abutment with the inner surfaces of downturned edge flanges 11 of said spacer clips and the said engagement of said upper transverse flanges by tabs 10. Upstanding flanges 7 formed on lower transverse flanges 8 and upper transverse flanges 9 act to stiffen, respectively, the lower and upper edges of said sill or hob mould side panels.

Chair 2 is fixed to formwork 3 by nails 12 or other suitable fastenings being driven through suitable apertures in transverse bottom part 13 of said chair. Chair side panels 14 pass upwardly with a lateral separation such as to provide sliding contact of their inner surfaces with the outer surfaces of said sill or hob mould side panels. Transverse bridge 15 fixed to said chair side panels with suitable fastenings 16 supports said sill or hob mould at the desired height above said formwork. Said side panels of said sill or hob mould are secured to said chair side panels by suitable fastenings passing through both. Said sill or hob mould, said chair and the area above said formwork to the desired level are then filled with concrete 18, thereby embedding said chair, and slab surface 19 and the upper surface of the concrete filling of said sill or hob mould are trowelled off to create the desired surface finishes. The fixing of bridge 15 and said sill or hob mould to said chair and the fixing of said chair to said formwork is normally carried out by the appropriate trades during the fixing of reinforcement bar, plates or mesh within said formwork. The height of said bridge is normally set to position the lower edge of said sill or hob mould at the surface of said concrete slab when poured. In alternative embodiments (not shown), the lower edge of said sill or hob mould is set above or below said slab surface when poured. In the preferred embodiment, where a large number of said chairs are required to have said bridges and said sill or hob moulds fixed to them, suitable jigs are provided to position said components appropriately, one to another, and to install said fastenings. Said fastenings optionally take the form of pop rivets, conventional screws or bolts screwed into tapped holes, conventional self-tapping screws, self-piercing and self-drilling/self-tapping screws, self-piercing rivets, hot-melt adhesives, quick-setting two-part adhesives, spot welding or any other suitable fixing means. When the concrete of said slab has cured, said formwork is stripped away and fastenings 12 are hammered flat or preferably cut off or ground away with an angle grinder or the like. In an alternative embodiment (not shown), sill or hob mould side panels 4 are attached to the outer edges of lower transverse flanges 8 by simple hinges, the arrangement permitting said sill or hob moulds to be opened out and shipped flat. When required for use, said side panels are pivoted upwardly through approximately 90° and a plurality of spacer clips 5 is slidingly engaged with upper transverse flanges 9 of said side panels, thereby retaining said sill or hob moulds in a fixed rectangular form.

With reference to FIGS. 4 and 5, a said chair in fixed into place on said formwork by the sprigs 22 of a fixing plate 21 being driven through suitable apertures 20 provided in transverse bottom part 13 of said chair. Said fixing plate is die-punched from a suitable metal sheet material and radially arranged projections 22 are turned through 90° to create attachment sprigs. The use of said fixing plate facilitates the accurate fixed location of said chair, said fixing plate being installed by a single blow from a suitable punch with a round, flared head, a suitable aperture being provided in bridge 15 (as depicted in FIG. 1) to provide access for said punch. In alternative embodiments (not shown), said chairs are fixed to said formwork using any suitable nails, screws or adhesives.

With reference to FIG. 6, two runs 23, 24 of said sill or hob mould are joined by joining member 25. Said joining member is fabricated from suitable sheet material, having the same width and depth as said sill or hob mould. In the preferred embodiment, said sill or hob mould side panels are provided at their upper and lower edges with transverse flanges (typically depicted as 9 and 8 in FIG. 7). Also in the preferred embodiment, the inner edges of said transverse flanges are turned through a further 90° to form inwardly directed flanges parallel to said side panels (depicted as 7 in FIG. 1). The ends of transverse spacers 26 are turned through 90° and spot welded to said upstanding flanges and maintain said side panels in fixed spatial relationship. Oblique strap 29 is spot welded to upper and lower transverse flanges 8 to strengthen the corner of said joining member. Transverse straps 27 are spot welded to said upper and lower transverse flanges to maintain a precise geometry of said sill or hob mould at the joining point, said sill or hob mould runs abutting said joining member at points 28. Doublings (not shown) are fixed to the inner surfaces of said joining member and extend outwardly to enter and abut the inner surfaces of the ends of said sill or hob mould side panels with a suitable degree of overlap. The fixing of said doublings to said side panels of said sill or hob moulds using suitable fastenings is the method of joining said sill or hob mould runs to said joining member. Said joining member is supported from said formwork by a chair having a square or equi-armed, L-shaped base, one corner or the apex 30 of which, respectively, is exposed. In the preferred embodiment, said corner or apex is fixed to said formwork (depicted as 3 in FIG. 1) using a fixing plate (depicted as 21 in FIG. 5). In alternative embodiments, any conventional fixing means are employed. Upwardly extending chair side panels 14 are fixed to or formed on the edges of said chair in appropriate positions such that their internal surfaces make sliding contact with the external surfaces of said sill or hob mould side panels. Bridges (depicted as 15 in FIG. 1) are fixed to said chair side panels to support said joining member at an appropriate height above said formwork. Said chair side panels are fixed to said sill or hob mould side panels in the manner described in relation to FIG. 1. Said joining members are optionally fabricated in different forms to join lengths of said sill or hob mould at a range of angles. Said joining members and said sill or hob mould are optionally made from a variety of materials, including light metal alloys, steel alloys and engineering polymers, where necessary, appropriately treated against corrosion.

Figure 7:
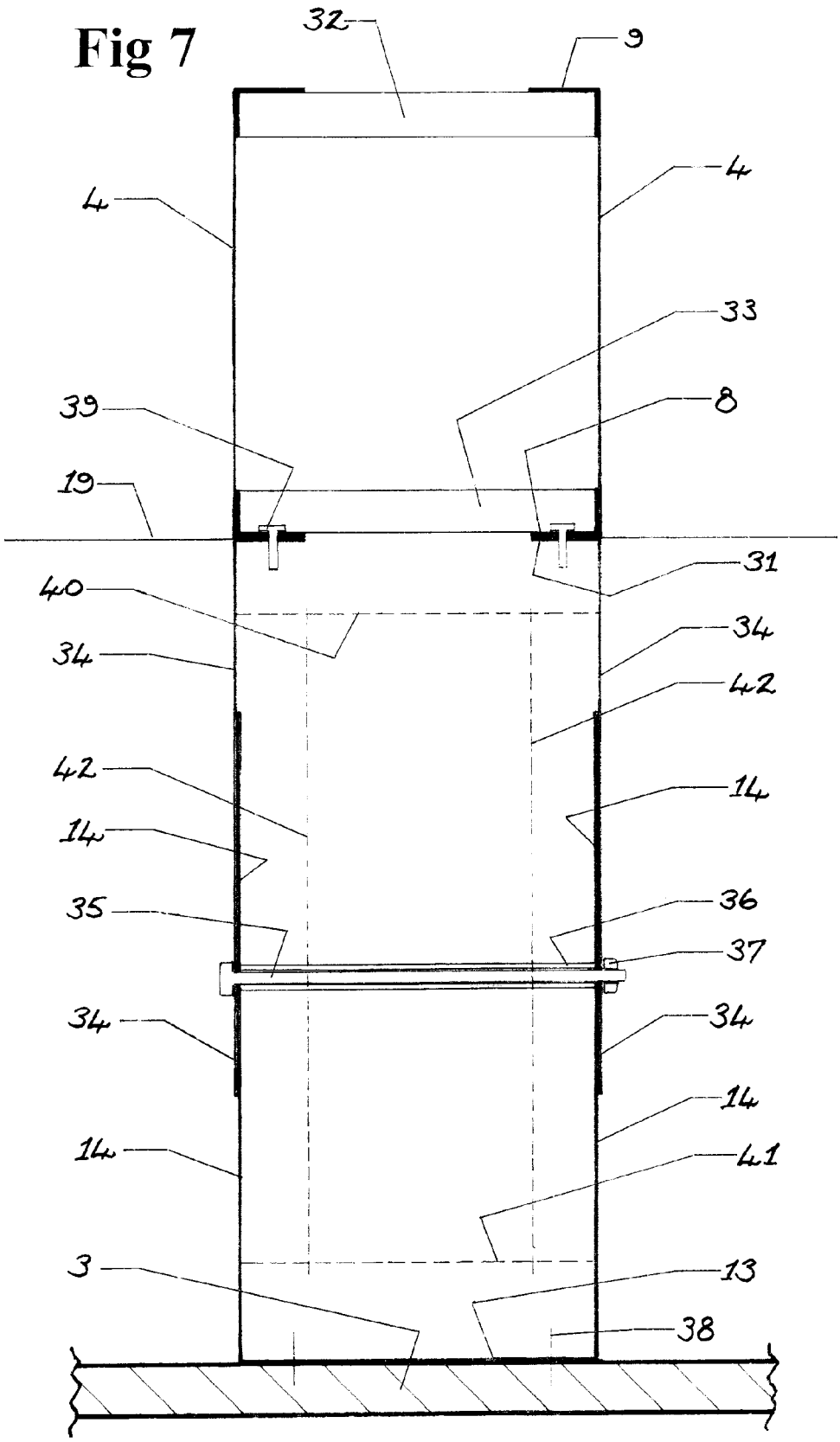
FIG. 7 is a transverse cross-sectional view of another embodiment of said sill or hob mould depicting two embodiments of said chair.

With reference to FIG. 7, in an alternative embodiment, said sill or hob mould is made with symmetrical side panels, the upper and lower edges of which are turned through 90° to create upper and lower transverse flanges 8, 9. The ends of transverse spacers 32, 33 are turned through 90° and spot welded to said side panels. In an alternative embodiment (not shown), said spacers are made in continuous, zigzag-type form with small flats parallel to said sill or hob mould side panels provided between each angled part, said flats being spot welded to said side panels. Said embodiment is suited for continuous production in which said side panels are formed up from continuous lengths of flat, rolled metal strip and straightened, said side panels are brought together with said continuous, zigzag-type spacers between them and said spacers are spot welded to said side panels. Depending upon the dimensions of said sill or hob mould, the vertical width of said transverse spacers and said zigzag-type spacers falls in the range 10 millimeters to substantially the same height as said sill or hob mould. In an alternative embodiment (not shown), said sill or hob mould is formed up from continuous lengths of rolled metal strip in a generally U-shaped form and panels of suitable size are punched or otherwise cut out from the lower transverse panel to create voids separated by narrow transverse strips. In this embodiment, for stiffening purposes, the upper edges of said side panels of said sill or hob mould are at least turned through 90° to form transverse flanges (depicted as 9 in FIG. 2). In the preferred embodiment, robotic spot welding means are employed to fix said spacers to said sill or hob mould side panels. Said chair is made with two overlapping or telescopic side panels 14, 34, the abutting surfaces of which are in sliding contact. Said side panels are made with coincident slotting and a bolt 35 passes through said slotting such that, when nut 37 is tightened onto the threaded end of said bolt, said side panels are captured between the ends of crush tube 36, the head of said bolt and said nut. The upper ends of chair side panels 34 are turned through 90° to create transverse fixing flanges 31. Said sill or hob mould is fixed to said chair by suitable fastenings 39 passing through lower transverse flanges 8 and transverse fixing flanges 31. The height of said sill or hob mould above formwork 3 is set by loosening nut 37, slidingly adjusting the height of said chair and re-tightening said nut. In an alternative embodiment (not shown), separate guide slots are provided in one pair of said chair side panels (14, 14 or 34, 34) which are engaged by suitable guide buttons provided on the other pair of said chair side panels, said embodiment acting to maintain said side panels in alignment during their said sliding adjustment. In another alternative embodiment (not shown), only one pair (14, 14 or 34, 34) of said chair side panels is slotted and said bolt is retained in suitable apertures in said other pair of side panels. Chair side panels 14 are fixed to formwork 3 by suitable fastenings (typical positions indicated in broken line as 38) driven through suitable apertures in transverse bottom part 13. In an alternative embodiment, a transverse partition (position depicted in broken line as 40) is provided joining the upper ends of chair side panels 34 and a transverse partition (position indicated in broken line as 41) is provided joining the lower ends of chair side panels 14. Height adjustment screws (positions indicated in broken line as 42) pass between said partitions, in the preferred embodiment, said screws being of the inter-screw type in which a male screw of conventional form with an extended threaded part engages a female (tubular) screw with an extended threaded part. Shortening of said screws (by deepening the engagement of the male screw with the female) acts to increase the height of said sill or hob mould above said formwork. In an alternative embodiment, said screws are long screws of conventional form and their heads are rotationally captured at one said partition, the other ends of said screws engaging nuts fixed to the other said partition. Rotation of said screws in the appropriate sense increases or decreases the height of said sill or hob mould above said formwork. The height of said sill or hob mould is normally set to position its lower edge at the finished surface of said slab when poured. In alternative embodiments (not shown), the lower edge of said sill or hob mould is set above or below said slab surface when poured. With additional reference to FIG. 28, in an alternative embodiment, chair 2 is made with a transverse top part 95 joining the upper edges of side panels 14 and said chair is fixed to formwork 3 by fastenings passing through suitable tabs or flanges 93 formed on the lower edges of said side panels. Said transverse top part is made with transversely arranged slots (not shown) which permit the lateral position of sill or hob mould 1 to be adjusted before said sill or hob mould is fixed to said chair with suitable fastenings (typical positions indicated as 94). In the preferred embodiment, said fastenings take the form of bolts passing through any of a plurality of suitable apertures (not shown) in narrow, transversely arranged strips 96 joining the lower edges of said sill or hob mould side panels, through said slots and screwably tightened into nuts (not shown) positioned beneath said chair transverse top part.

With reference to FIG. 8, said sill or hob mould is extruded in a continuous length from a thermoplastic polymer material or light metal alloy material. Said extruded section comprises two side panels 43 connected at the lower end by a transverse web which is punched or otherwise cut out to create voids 46 separated by narrow transverse strips. Longitudinal rails 44, 45 are provided along the upper and lower inner edges of said side panels and channels 47, 48 are provided in said rails. Said channels are made with an approximately circular cross-sectional shape to which access is gained via slots. Said slots are orientated, respectively in relation to channels 47, 48, upwardly and downwardly. Said slots taper inwardly to a width being approximately 10% to 20% smaller than the diameter of said channels and, as such, form constricted entries to said channels. Said chair side panels (not shown) are made with their upper edges substantially cylindrical in form and with a diameter able to be neatly accommodated within channels 48. Said sill or hob mould is fixed to said chair by said chair side panel upper edges being forced through said slots to frictionally engage channels 48. Closure 49 is made with shallow longitudinal rails 50 along each edge, the free edges of said rails being made in substantially cylindrical form with a diameter able to be neatly accommodated within channels 47. Said closure is fixed to said sill or hob mould by said rail edges being forced through said slots to frictionally engage channels 47. In an alternative embodiment (not shown), suitable apertures are punched or otherwise cut out from said closure to create voids separated by narrow transverse strips. In another alternative embodiment (not shown), said sill or hob mould is extruded in a single section, with side panels 43 connected at their upper and lower ends by transverse webs which are both punched or otherwise cut out to create voids separated by narrow transverse strips. In another alternative embodiment (not shown) said chair side panels are made from metal sheet and their upper edges are made into a substantially cylindrical form by rolling or by fixing a wire along said edges, the diameter of said rolling or said wire being such as to be neatly accommodated within channels 48.

With reference to FIG. 9, said sill or hob mould is made in asymmetric cross-sectional form, with a first flat face 52 and a second face 53 shaped to suit a particular application. In the embodiment shown, said second face is made concave with said mould increasing in width downwardly to suit the mounting of a hospital wall in which vinyl floor tiles are curved to pass from the floor surface to the wall surface. The arrangement is intended to improved hygiene by eliminating the difficult-to-clean zone normally existing at the junction of a wall with a floor surface. The upper edges of said side panels are turned through 90° to create upper transverse flanges 54 and transverse or zigzag-type spacers 57 of the type described in relation to FIG. 7 are spot welded to said side panels. Longitudinally arranged angles 55, 56 are spot welded to the lower inner edges of said side panels and transverse or zigzag-type spacers 58 of the type described in relation to FIG. 7 are spot welded to said angles. Curved side panel 53 is extended vertically downwards to create apron 59 such that, when said sill or hob mould is embedded in the surface of a concrete building slab (typical surface level of said slab indicated as 19), said apron forms a positive moisture barrier.

Figure 10A:
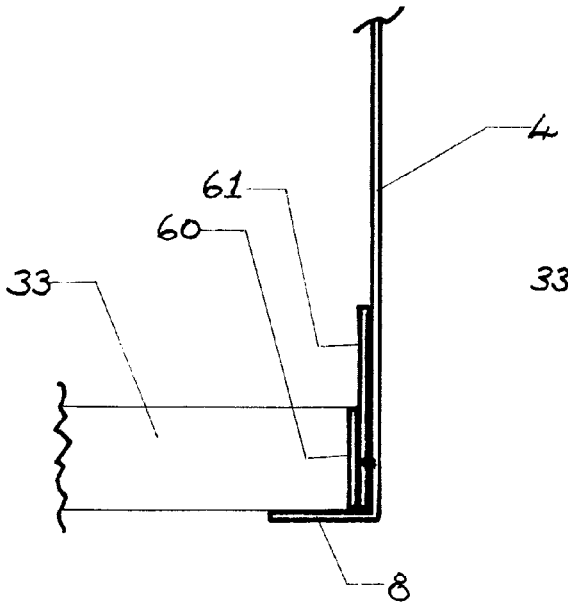
FIG. 10*a* is a fragmentary transverse cross-sectional view of means to join spacers to the side panels of said sill or hob moulds.
Figure 10B:
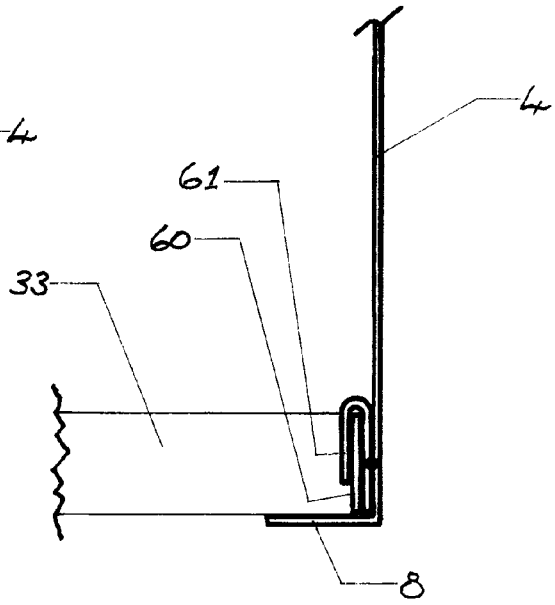
FIG. 10*b* is a fragmentary transverse cross-sectional view of the joining means of FIG. 10*a* following their setting.

With reference to FIG. 10*a*, the lower edge of said sill or hob mould side panel 4 is turned through 90° to create lower transverse flange 8. Tab 61 is spot welded at its lower end to said side panel. Flat 60 of a zigzag-type spacer 33 of the type described in relation to FIG. 7 abuts said side panel. With additional reference to FIG. 10*b*, said tab has been bent downwardly and against said flat, thereby fixing said spacer to said side panel.

Figure 11:
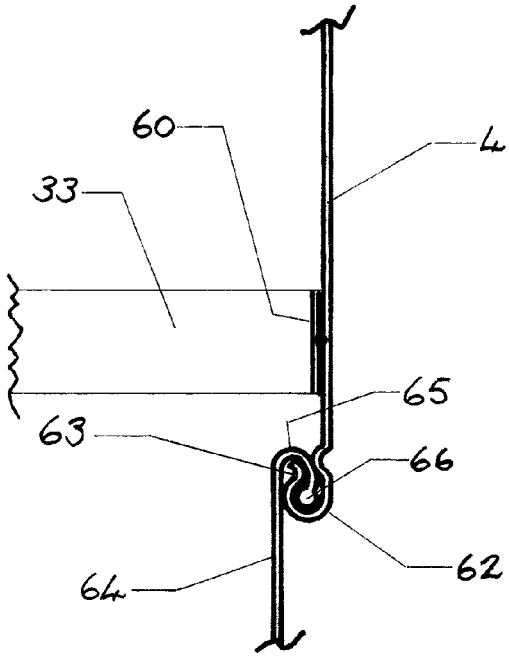
FIG. 11 is a fragmentary transverse cross-sectional view of means to join said sill or hob moulds to said chairs.

With reference to FIG. 11, the lower edges of said sill or hob mould side panel side panel 4 of have been turned through approximately 180° to create channels 62 with lipped, constricting edges 63. The upper edges of chair side panels 64 are made with substantially cylindrical edges 66 which are turned through approximately 180° at bends 65. In the preferred embodiment, said chair side panels are made from metal sheet and their upper edges are made into substantially cylindrical form by rolling or by fixing of a wire along said edges, the diameter of said rolling or said wire being such as to be neatly accommodated within channels 62. Said sill or hob mould is fixed to said chair side panel edges by edges 66 being forced past constricting edges 63 to be frictionally captured within channels 62. The turned ends 60 of transverse spacer 33 (or flats of zigzag-type spacers of the type described in relation to FIG. 7) are spot welded to said sill or hob mould side panels. In an alternative embodiment (not shown), part of said lower edges of said sill or hob mould side panels of suitable width are turned upwardly and tightly through 180° and approximately half of the upturned part is then turned downwardly through 180° to create downwardly orientated channels with constricting edges of the type depicted in FIG. 11. The upper edges of said chair side panels are made rolled or wired as described in relation to FIG. 11, said edges being of a diameter as may be neatly accommodated within said channels. Said sill or hob mould is fixed to said chair by said rolled or wired edges being forced past said constricting edges to be frictionally captured within said channels.

Figure 12:
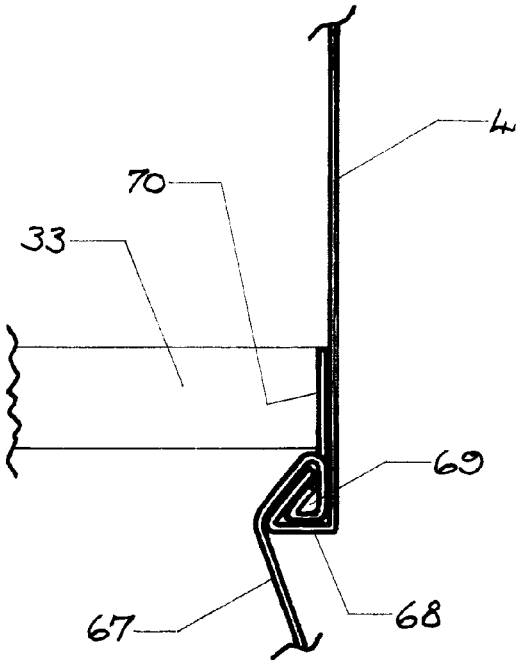
FIG. 12 is a fragmentary transverse cross-sectional view of means to join said sill or hob moulds to said chairs or to join spacers to the side panels of said sill or hob moulds.

With reference to FIG. 12, short, downwardly projecting parts of the lower edges of said sill or hob mould side panels 4 are double folded to create a plurality of more or less triangular sections 68. Short upwardly projecting parts of the upper edges of said chair side panels are double folded to create a plurality of more or less triangular sections 69 able to be neatly accommodated within sections 68. Said sill or hob mould is fixed to said chair side panels by sections 69 being interdigitated between sections 68, the former then being displaced laterally to enter and be frictionally captured within the latter. In an alternative embodiment (not shown), the turned ends 70 of transverse spacer 33 (or flats of zigzag-type spacers of the type described in relation to FIG. 7) are made with downwardly extending parts which are double folded into more or less triangular sections able to be frictionally captured within sections 68 in the manner described.

Figure 13A:
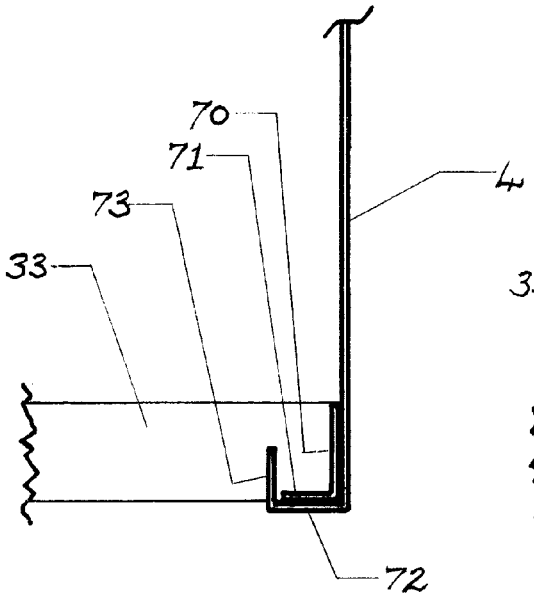
FIG. 13*a* is fragmentary transverse cross-sectional view of means to join spacers to the side panels of said sill or hob moulds.

With reference to FIG. 13*a*, the lower edges of said sill or hob mould side panels 4 are double folded to form lower transverse flanges 72 with short lengths of upstanding flange 73 formed on them. The turned ends 70 of transverse spacers 33 (or flats of zigzag-type spacers of the type described in relation to FIG. 7) are made with short lateral extensions 71 formed on their lower edges. With additional reference to FIG. 13*b*, lengths of upstanding flange 73 have been folded down to capture short lateral extensions 71, thereby fixing said transverse spacers to said side panels.

Figure 14:
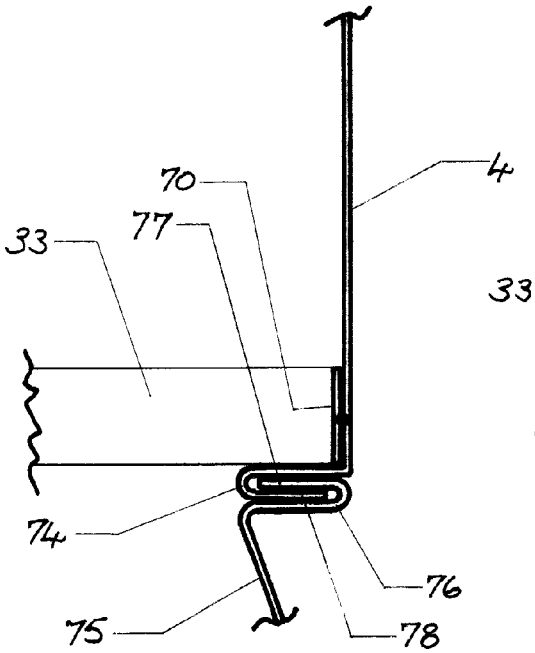
FIG. 14 is a fragmentary transverse cross-sectional view of means to join said sill or hob moulds to said chairs.

With reference to FIG. 14, the lower edges of sill or hob mould side panels 4 are turned inwardly through 90° and approximately half of said turned part turned outwardly through 180° to create outwardly orientated attachment channel 74. The upper edges of said chair side panels are treated in a reciprocal way to create inwardly orientated attachment channel 76. Said sill or hob mould is fixed to said chair by the free end 77 of said chair side panel upper edge being accommodated within attachment channel 74 and the free end of sill or hob mould side panel lower edge 78 being accommodated within attachment channel 76. The turned ends 70 of transverse spacers 33 (or flats of zigzag-type spacers of the type described in relation to FIG. 7) are spot welded to said sill or hob mould side panel.

Figure 15:
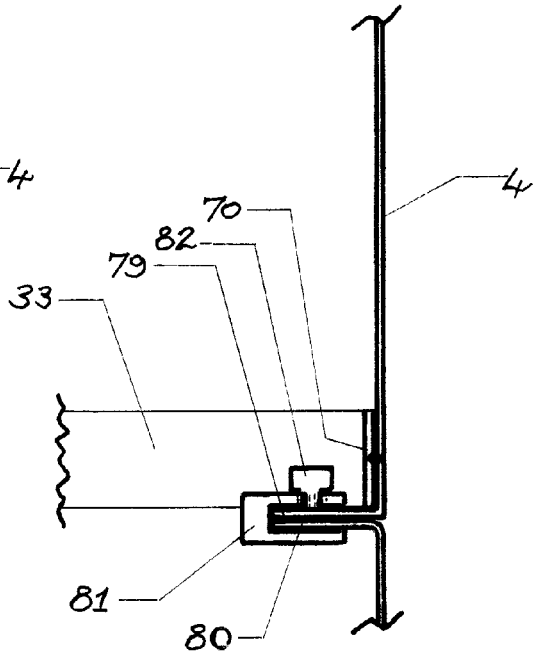
FIG. 15 is a fragmentary transverse cross-sectional view of alternative means to join said sill or hob moulds to said chairs.

With reference to FIG. 15, the lower edges of said sill or hob mould side panels are turned through 90° to create lower transverse flange 79. The upper edges of said chair side panels are turned through 90° to create attachment flanges 80. Said sill or hob mould is fixed to said chair by the abutting said lower transverse flange and attachment flange being clamped together by screw means 82 or a plurality of suitably spaced clamps 81. The turned ends 70 of transverse spacers 33 (or flats of zigzag-type spacers of the type described in relation to FIG. 7) are spot welded to said sill or hob mould side panel.

Figure 13B:
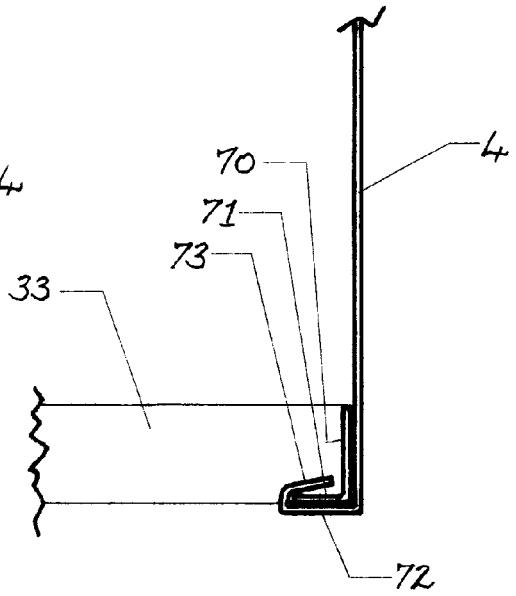
FIG. 13*b* is a fragmentary transverse cross-sectional view of the joining means of FIG. 13*a* following their setting.

With reference to FIG. 16, the side panels 4 of said sill or hob mould are joined at their upper and lower edges by a continuous length of zigzag-type spacers of the type described in relation to FIG. 7, said spacers being attached to said side panels as described in relation to FIGS. 13*a* and 13*b*. In this embodiment, flats of said spacers are provided with short lateral extensions 71 formed on their lower edges, short upstanding flanges 73 formed on the inner edges of lower transverse flanges 72 being folded down to capture said short lateral extensions. Said embodiment is suited for continuous production in which said side panels are formed from rolled metal strip and straightened, said side panels are brought together with said continuous, zigzag spacers between them and said spacers are fixed in the manner described to said side panels. In an alternative embodiment (not shown), said spacers are made in the form of a continuous sinusoidal curve and are clipped into place in the manner described in relation to this Figure or are spot welded into place at the points of contact with said side panels.

With reference to FIG. 17, side panels 4 of said sill or hob mould are joined by a plurality of transverse spacers 26, the turned ends 70 of which are spot welded to the upper and lower edges of said side panels. Said embodiment is suited for continuous production in which said side panels are formed up from flat, rolled metal strip and straightened, said side panels are brought together with said transverse spacers between them and said spacers are spot welded to said side panels.

With reference to FIG. 18, the lower and upper edges of sill or hob mould side panels 4 are turned through two 90° folds to form lower and upper transverse flanges 77, each having short upstanding or downwardly directed (as appropriate) flanges 76 formed on them. Clips 74 are folded over the turned ends 70 of transverse spacers 33 (or flats of zigzag-type spacers of the type described in relation to FIG. 7) and lateral extensions 75 of said clips are positioned to abut said lower or upper (as appropriate) transverse flanges. Upstanding or downwardly directed (as appropriate) flanges 76 are then folded inwardly to capture said turned ends of transverse spacers 33 (or flats of zigzag-type spacers of the type described in relation to FIG. 7), thereby joining said sill or hob mould side panels one to another.

With reference to FIG. 19, sill or hob mould 1 is supported at either side upon parallelogram mechanisms formed from upper straps 84, 85, 86 the upper ends of which are pivotally joined to the lower edges of said sill or hob mould at pivots 78 positioned on each side of said sill or hob mould and pivotally joined to lower straps 87, 88, 89 at the ends of transverse nut bar 82, at laterally located pivots 92 and at transverse bearing bar 83. Said lower straps are pivotally joined to formwork 81 at pivots 79. Links 91 on either side maintain said nut bar and pivots 92 in fixed spatial relationship. Threaded rod 90 is rotationally captured in a medially positioned bearing (not shown) in said bearing bar and knob 80 is provided to turn it. Said threaded rod passes between laterally located pivots 92 and its distal end is screwably engaged with a medially positioned nut (not shown) in said transverse nut bar, rotation of said threaded rod in the appropriate direction acting to draw said bearing bar and said nut bar closer together or to increase their separation, thereby increasing the height of said sill or hob mould above said formwork of reducing said height. In the preferred embodiment, said straps are made from a stiff metal section and said pivots are made tight with no free play, thereby minimizing any tendency for said sill or hob mould to sway or otherwise deviate from its desired position. The advantage of the said embodiment is its ability to provide precise height adjustment of said sill or hob mould. In the preferred embodiment, pivots 79 are fixed in common to a plate which is, in turn, fixed to said formwork.

With reference to FIG. 24, in an alternative embodiment, a chair to support said sill or hob mould comprises base plate 97 to which is fixed two, parallel, threaded supporting rods 98 of suitable length orientated normal to said base plate. Parallel slots 99 are provided in said base plate.

With additional reference to FIG. 20, in an alternative embodiment, base plate 97 is made with one or more slots 99. Clamp 107 comprises flat base part 100 on one end of which is formed supporting piece 101. Fixing screw 103 passes through a said slot and through medially positioned aperture 102 in said flat base part and its threaded part is screwably engaged with the complementary thread of a suitable aperture (not shown) provided in jaw 104. One end of said jaw is formed into tongue 105 which passes through a suitable aperture positioned towards the free end of said supporting piece. With said fixing screw loosened, said clamp may be slidably positioned along slot 99 of plate 97 and a reinforcing bar 106 may be positioned between adjacent faces of said flat base part and said jaw. Tightening of said fixing screw simultaneously locks said clamp to said plate and seizes said reinforcing bar between said flat base part and said jaw.

With reference to FIG. 21, in an alternative embodiment, a chair to support said sill or hob mould comprises base plate 97 to which are fixed two, parallel, threaded supporting rods 98 of suitable length orientated normal to said base plate. One or more slotted apertures 108 are provided in said base plate and suitable fastenings passing through said apertures are employed to fix said base plate to supporting bars (not shown) which are, in turn, fixed to reinforcing bars (not shown) by a variety of fixing means (not shown). Said slotted apertures permit positional adjustments of said base plate to be made before said base plate if fixed to said supporting bars. In other alternative embodiments (not shown), said chairs comprising base plate and parallel, threaded supporting rods are fixed to said formwork by means of suitable fastenings passing through slotted openings in said baseplate. In these embodiments, said slotted openings permit positional adjustment of said chair prior to tightening of said fastenings.

With reference to FIG. 22, in an alternative embodiment, the base plate 97 of a said chair is provided with one or more slots 99 from which clips 109 are supported by the screwable engagement of the threads of their fixing screws 110 with complementary threads of a bore 112 provided in attachment boss 111. Said fixing screws pass through said slots and, with said fixing screws loosened, said clips may be positioned to permit them to engage and be frictionally attached to reinforcing bars (not shown). Tightening of said fixing screws acts to fix said clips to said base plate and, thereby, to fix said base plate to said reinforcing bar.

With reference to FIG. 23, in an alternative embodiment, base plate 97 of a said chair is made with one or more slots 113. Threaded rods 114 of said chair are fixed to said base plate by upper nuts 117 being screwably displaced on the threading of said rods against lower nuts 115. Suitable shoulders 116 of said lower nuts engage said slots, thereby preventing said lower nuts from turning during tightening of said upper nuts. Obviously, the height of a said threaded rod on said base plate may be adjusted by screwably displacing said upper and lower nuts on said threaded rods.

With reference to FIG. 26, in an alternative embodiment, a chair to support said sill or hob mould comprises base plate 97 to which are fixed two, parallel, threaded supporting rods 98 of suitable length orientated normal to said base plate. Suitable apertures 118 are provided in said base plate to facilitate a flow of concrete through said base plate. Suitable fixing apertures 119 are provided around the periphery of said base plate and said base plate is secured to reinforcing bar (not shown) by wire ties passed through said fixing apertures, around said reinforcing bar and the ends twisted together and tightened.

With reference to FIG. 27, in an alternative embodiment, the base plate 97 of a said chair is provided with upstanding edge flanges 120 provided with longitudinally orientated slots 127. Clips 128 are supported from said edge flanges by their fixing screws 121 passing through said slots, through spacer tubes 122 and through attachment webs 123 of said clips such that their threaded parts screwably engage and are tightened into complementary threads in nuts 124. In the preferred embodiment, said clips are of the larger alligator type. With said fixing screws loosened, said clips may be positioned on said edge flanges to permit them to engage and be attached to reinforcing bars (not shown). Tightening of said fixing screws acts to fix said clips to said base plate edge flanges and, thereby, to fix said base plate to said reinforcing bar. Where the height of said base plate is required to be adjusted in relation of said reinforcing bar, said fixing screws are loosened, said clips are partially released from said reinforcing bar and said clips are rotated on said fixing screw as required to perform said height adjustment. Said clips are then permitted to engage said reinforcing bar and said fixing screws are re-tightened.

With reference to FIG. 25, in an alternative embodiment, sill or hob mould 1 is supported on threaded supporting rods 98 fixed to a base plate (not shown). Threads of nuts 129 are screwably engaged with complementary threads of said supporting rods and tubular projections 130 formed on the upper ends of said nuts pass upwardly through suitable apertures 132 provided in narrow, transversely arranged strips 96 joining the lower edges of said sill or hob mould side panels 4. Dished, metal spring washers 131 are pressed over said tubular projections with small sprigs (not shown) formed around their central apertures engaging the external surfaces of said tubular projections, thereby retaining said spring washers in place and which, by urging said transversely arranged strips against shoulders 133 of said nuts, act to retain said sill or hob moulds in the correct vertical attitude on said supporting rods. In the preferred embodiment, said threading of said supporting rods is made coarse and said nuts are formed from a suitable thermoplastic polymer material providing a firm frictional engagement with said threading. Also in the preferred embodiment, the upper ends of said tubular projections are made hexagonal or other shape intended for engagement by a suitable tool employed to turn said nuts on said supporting rods. Also in the preferred embodiment, said tool is a tube spanner.

In alternative embodiments (not shown), the rods of said base plate and rod-type chair are made plain and unthreaded and said sill or hob mould is secured in place on said rods by suitable clips frictionally attached to said rods above and below the appropriate surfaces of said sill or hob mould.

Figure 29A:
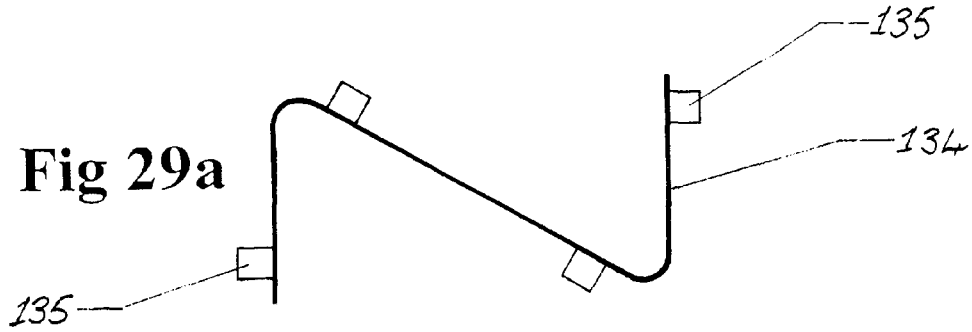
FIGS. 29*a*, 29*b*, 29*c* and 29*d* are transverse cross-sectional views of alternative forms of chair.
Figure 29B:
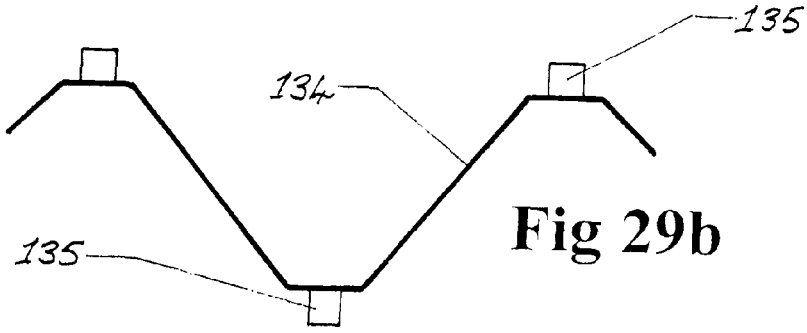
Figure 29C:
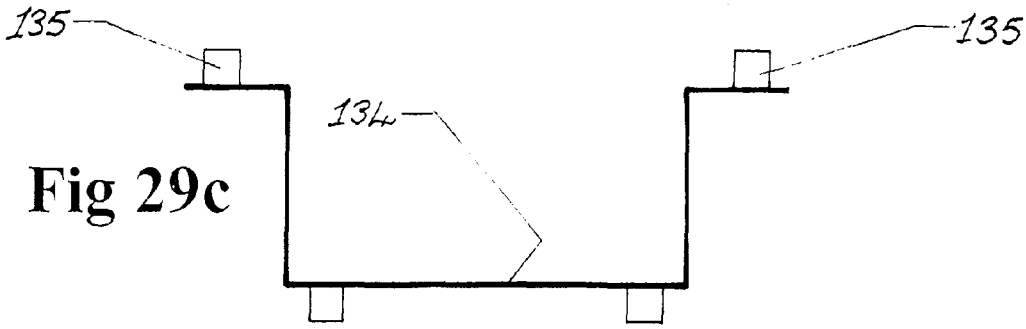
Figure 29D:
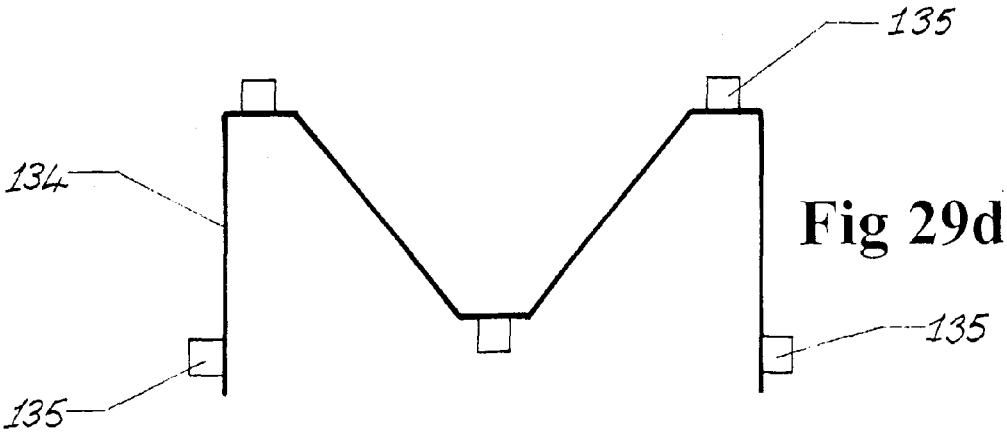

With reference to FIGS. 29*a*, 29*b*, 29*c* and 29*d*, said sill or hob mould is supported upon a chair formed from a suitable length of folded metal section 134. The cross-sectional shape of said folded metal section is selected to provide torsional, transverse and longitudinal stiffness. In the preferred embodiment, said folded metal section is cut to length by shearing between two dies shaped to match its said cross-sectional shape. According to the attachment requirements of said folded metal section, it is optionally cut straight across or, where appropriate, said dies are shaped to provide a plurality of attachment tabs 135 formed on one or both ends. Said attachment tabs are employed, as appropriate, to fix the lower end of said chair to a base plate or its upper end to said sill or hob mould. In the preferred embodiment, suitably positioned slots are punched in said base plate or said sill or hob mould base using a portable hydraulically-operated punch. As depicted in FIGS. 30 to 32, said attachment tabs are passed up through said slots and are bent over flat to secure said folded metal section into place. In an alternative embodiment (not shown), said attachment tabs are twisted through approximately 90° to effect the attachment of said folded metal section. In another alternative embodiment (not shown), said attachment tabs are passed through suitable apertures and secured by welding. The embodiment of said folded metal section depicted at FIG. 29*b* is preferred as it provides the necessary positional stability with the use of only three said attachment tabs.

With reference to FIG. 30, a chair comprises folded metal section 134 and side panels 31. The lower end of said folded metal section is fixed to base plate 137 by a plurality of attachment tabs 135 passed through suitable slots and folded flat. Said base plate is suitably joggled to accommodate said attachment tabs and is fixed to formwork 3 by means of suitable fasteners (positions indicated as 136). The upper ends of said chair side panels are turned through 90° to create transverse fixing flanges 31. Sill or hob mould 4 is fixed to said chair by suitable fastenings (positions indicated as 39) passing through lower transverse flanges 8 of said sill or hob mould and transverse fixing flanges 31. Vertical slots (not shown) are provided alternatively in side panels 34 or the sides of said folded metal section with suitable apertures in the other. Suitable fastenings (positions indicated as 138) passing through said side panels and said sides of said folded metal sections permit sliding height adjustment of said sill or hob mould when loosened. Obviously, in an alternative embodiment (not shown), said folded metal section may be cut to the requisite length and its upper end fixed directly to said sill or hob mould. Where this embodiment is employed, transverse strips of material are provided across the lower surface of said sill or hob mould to permit said fixing of said folded metal section. In another alternative embodiment (not shown), a similar sectional shape moulded from a suitable polymer material replaces said folded metal section and its ends are fixed to said sill or hob mould or said base plate by its said attachment tabs being passed through suitable slots and fused with a suitable hot implement. Obviously, said folded metal section may take a large variety of other cross-sectional shapes.

With reference to FIG. 32, attachment tabs 135 on an end of folded metal section (position indicated in broken line as 134) are folded over flat to fix said folded metal section to sill or hob mould or baseplate 139.

With reference to FIG. 31, in an alternative embodiment, said attachment tabs are made in closely-spaced pairs 141, 142 and said folded metal section is fixed to sill or hob mould or baseplate 139 by passing said attachment tabs through a common slot 140 and then bending them flat in opposed senses.

Chairs formed from a closed cross-sectional shape, for example, round, square, oval or triangular, all with plain, perforated or ribbed sides, are optionally employed where a void in a concrete slab may be tolerated.

In an alternative embodiment (not shown), a sealing compound is applied to the inner surfaces of said sill or hob mould, said sealing compound dispersing into the concrete with which said mould is filled. Said sealing compound preferably takes the form of one such as Xypex®, distributed by Xypex Australia, of 45 Union Road, North Albury, NSW 2641, Australia, in which reactive chemicals diffuse into concrete using water as a migrating medium and crystallize to form a non-soluble filling of pores and capillary tracts in the cured concrete. Said sealing compound is applied in dry form with a suitable binder to the inner surfaces of said sill or hob mould and is activated by the filling of said mould with concrete.

In another alternative embodiment (not shown), said sill or hob mould, immediately following pouring of a building concrete slab, is filled with concrete containing a waterproofing compound.

In another alternative embodiment (not shown), said sill or hob mould side panels are provided with vertical or horizontal fluting, ribbing or doubling or are otherwise treated to provide increased stiffness.

In another alternative embodiment (not shown), the upper and lower edges of said sill or hob mould side panels are rolled, ribbed or folded to provide increased stiffness.

In another alternative embodiment (not shown), channels or other sections are fixed to the upper and lower inner surfaces of said sill or hob mould side panels to provide increased stiffness.

In another alternative embodiment (not shown), transverse stiffeners of the type depicted as 27 in FIG. 6 are welded to the outer or inner surfaces of transverse upper and lower flanges (depicted as 8 and 9 in FIG. 7). Where said sill or hob mould is made from a light metal alloy material, said transverse stiffeners are optionally fixed by cold pressure welding. Where said sill or hob mould is made from a steel alloy material, said transverse stiffeners are fixed by spot welding.

In another alternative arrangement (not shown), the side panels of said chair are effectively made telescopic as depicted in FIG. 7 and the abutting surfaces of said side panels have formed on them complementary, ratchet-type projections which permit telescopic extension but prevent telescopic collapse. In use, said sill or hob mould is temporarily supported from said formwork at the correct height and said chair side panels are then telescopically extended and fixed to said mould to provide sustained support. Should there be a requirement to telescopically collapse said chair side panels, they are removed and physically separated for this purpose.

In another alternative embodiment (not shown), the height of said sill or hob mould on said chair is adjusted by positioning pairs of opposed wedges between them. Slots are provided through said wedges to accommodate a draw bolt which is employed to draw said wedges together or increase their spacing, as appropriate.

In another alternative embodiment (not shown), to minimize the possibility of conflict with reinforcing bar, plate or mesh installed in said formwork, the transverse bottom part of said chair (depicted as 13 in FIG. 1) is deleted and the lower edges of said chair side panels are provided with tabs, flanges of other means for attachment to said formwork.

In another alternative embodiment (not shown), a clearly visible gauge make is provided on the side panels of said chair or said sill or hob mould up to which concrete is filled in the pouring of a building concrete slab.

In another alternative embodiment (not shown), said sill or hob mould is made in a regularly curved planform to meet the needs of a particular architectural situation. In this embodiment, said sill or hob mould construction is of the type described in relation to FIG. 7, said side panels first being separately curved to the correct radius and then joined by transverse or zigzag-type spacers which are preferably spot welded into place. Said chairs are positioned as required to support said curved mould. In another alternative embodiment (not shown), said sill or hob mould is made in an irregularly shaped planform to suit a particular architectural situation, the method of manufacturing said sill or hob mould being generally as described for that with a regularly curved planform.

In another alternative embodiment (not shown), a plurality of free standing said chairs are distributed over said formwork prior to pouring of a building concrete slab and are employed as level gauges during said pouring.

In another alternative embodiment (not shown), said chairs and said sill or hob moulds are made in ranges of heights and widths to suit a variety of architectural applications.

In the present invention, except where clearly impractical, any feature described in one embodiment should be taken as able to be used in combination with any feature of another embodiment.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An elongated hollow mould and chair combination for the formation of an integral raised sill or hob on the surface of a cast-in-situ concrete building slab, said mould being elongated and hollow and comprising two generally parallel, continuous side panels joined in fixed spatial relationship at their upper and lower edges by upper and lower spacer elements which permit the entry of concrete from above and the passage of concrete therethrough to formwork below upon which said slab is to be formed, thereby making the concrete within said filled mould contiguous with that of said concrete slab beneath; said mould being supported upon a plurality of discrete chairs, each said chair comprising two narrow, parallel, vertically oriented side panels joined at their lower ends by a transverse bottom part fixed to said formwork, said mould being supported in a said chair by a transverse bridge which may be fixed at any particular height along said chair side panels, joining members shaped to engage the ends of said mould and incorporating overlapping doublings being employed to join sections of said mould.

2. The mould and chair combination of claim 1 in which said transverse bridge is fixed to said chair side panels to support said mould with its lower surface coplanar with the upper surface of said concrete slab.

3. The mould and chair combination of claim 1 in which the upper and lower edges of said mould side panels are turned inwardly through an angle of at least 90 degrees to form upper and lower transverse flanges which act to stiffen said upper and lower edges.

4. The mould and chair combination of claim 1 in which said mould side panels are joined at the upper edges by said upper spacer elements which are narrow (in an axial sense of said mould) and well separated, said upper spacer elements engaging the upper, outer edges of said mould and retained in place by tabs formed on said upper spacer elements engaging the lower surfaces of upper transverse flanges of said mould.

5. The mould and chair combination of claim 1 in which said mould side panels are joined at the lower edges by said lower spacer elements fixed to the inner surfaces of upstanding flanges which are formed on lower transverse flanges of said mould.

6. The mould and chair combination of claim 5 in which said lower spacer elements take the form of short cut pieces of rectangular tubing tack welded to the inner edges of said side panel lower transverse flanges.

7. The mould and chair combination of claim 1 in which said transverse bridge and said mould side panels are fixed to said chair side panels by suitable fastenings.

8. The mould and chair combination of claim 7 in which a jig is employed to correctly position said transverse bridge and said mould in said chair prior to the installation of said fastenings.

9. The mould and chair combination of claim 1 in which a mould and chair combination is set in place and fixed to said formwork as part of the process of setting the reinforcing bar of said concrete slab into place.

10. The mould and chair combination of claim 1 in which said mould side panels are attached by a hinge arrangement to said lower spacer elements, allowing said mould to be opened out and shipped flat.

11. The mould and chair combination of claim 1 in which two intersecting runs of said mould are joined by a joining member comprising side panels having the same height and lateral spacing of those of said mould, the upper and lower edges of said side panels being turned inwardly twice through an angle of 90 degrees to form upper and lower channels having an inner face parallel to said side panels and which act to stiffen said upper and lower edges, transverse spacers being welded to said inner faces to maintain said side panels in fixed spatial relationship; an oblique strap being welded at top and bottom to both parts of said joining member over the line of intersection and doublings being fixed to the inner surfaces of said side panels and extending axially outwards to slidingly engage and overlap the inner surfaces of the ends of runs of said mould to be joined by said joining member; said joining member being supported on a chair comprising a square or equi-armed, L-shaped base plate fixed to said formwork, said base plate supporting two parallel, appropriately positioned pairs of side panels, each said pair of side panels supporting a transverse bridge which, in turn, supports one part of said joining member at an appropriate height above said formwork, said transverse bridge and said joining member being fixed to said side plates with suitable fastenings.

12. The mould and chair combination of claim 11 in which said joining member is made to accommodate runs of said mould intersecting at a variety of angles.

13. The mould and chair combination of claim 1 in which said mould is made with symmetrical side panels, the upper and lower edges of which are turned through 90° to create upper and lower transverse flanges, said side panels being maintained in fixed spatial relationship by the ends of transverse spacers being turned through an angle of 90 degrees with the turned parts welded to the upper and lower inner surfaces of said side panels; the vertical width of said transverse spacers falling in the range 10 millimeters to substantially the same height as said mould.

14. The mould and chair combination of claim 1 in which said mould is made with symmetrical side panels, the upper and lower edges of which are turned through 90° to create upper and lower transverse flanges, said side panels being maintained in fixed spatial relationship by spacers made in continuous, zigzag-type form with small flats parallel to said mould side panels provided between each angled part, said flats being welded to the upper and lower inner surfaces of said side panels; the vertical width of said zigzag-type spacers falling in the range 10 millimeters to substantially the same height as said mould; said mould adapted to be made in continuous lengths.

15. The mould and chair combination of claim 1 in which said mould is formed up from a continuous length of strip material in a generally U-shaped form and panels of suitable size are punched or otherwise cut out from the lower transverse panel to create voids separated by narrow transverse strips at regular intervals, the upper edges of said side panels of said sill or hob mould being turned through an angle of at least 90 degree to form transverse stiffening flanges.

16. The mould and chair combination of claim 14 in which said chair is made with telescopic side panels to permit adjustment of the height of said chair, said side panels having complementary first slotting to permit said adjustment by the loosening of fastenings.

17. The mould and chair combination of claim 16 in which the upper ends of said telescopic side panels are turned through an angle of 90 degrees to create transverse fixing flanges, said mould being fixed to said chair by suitable fastenings passing through said lower transverse flanges and said transverse fixing flanges.

18. The mould and chair combination of claim 17 in which said transverse fixing flanges formed on the upper edges of said chair side panels are provided with lateral second slotting to permit adjustment of the alignment of a said mould on its said chair before being fixed into position.

19. The mould and chair combination of claim 1 in which the height of the lower surface of said mould is set above or below the upper surface of said concrete slab.

20. The mould and chair combination of claim 1 in which said mould is extruded in a continuous length from a thermoplastic polymer material or light metal alloy material, said extruded section comprising two side panels connected at the lower end by a transverse web which is punched or otherwise cut out to create voids separated by narrow transverse strips at regular intervals, longitudinal rails being provided along the upper and lower edges of said side panels, channels of approximately circular cross-sectional shape being formed in said rails and access to said channels being gained via constricted, upwardly and downwardly directed slots; said chair side panels being made with their upper edges substantially cylindrical with a diameter able to be neatly accommodated within said channels, said mould being fixed to said chair by forcing of said chair side panel upper edges through said slots to frictionally engage said channels; a closure being made with shallow longitudinal rails along each lower edge, the free edges of which are made substantially cylindrical with a diameter able to be neatly accommodated within said channels, said closure being fixed to said mould by forcing of its said rail edges through said slots to frictionally engage said channels.

21. The mould and chair combination of claim 20 in which suitable apertures are punched or otherwise cut out from said closure to create voids separated at regular intervals by narrow transverse strips.

22. The mould and chair combination of claim 20 in which said mould is extruded in a single section, with said side panels connected at their upper and lower ends by transverse webs, both of which are punched or otherwise cut out to create voids separated at regular intervals by narrow transverse strips.

23. The mould and chair combination of claim 20 in which said chair side panels are made from metal sheet material and their upper edges are made substantially cylindrical by rolling or by fixing a wire along said edges, the diameter of said rolling or said wire being such as to be neatly accommodated within said channels of said mould.

24. The mould and chair combination of claim 1 in which said mould is made in asymmetric cross-sectional form, with one said side panel made flat and the other said side panel shaped to suit a particular application, said shaped side panel optionally being made concave with said mould increasing in width downwardly to suit, for example, the base of a hospital wall in which vinyl floor tiles are curved to pass from the floor surface to the wall surface, the embodiment acting to improve hygiene by eliminating the difficult-to-clean zone normally existing at the junction of a wall with a floor surface.

25. The mould and chair combination of claim 24 in which the upper edges of said side panels are turned through an angle of 90 degrees to create upper transverse flanges and transverse or zigzag-type spacers are welded to the upper, inner surfaces of said side panels, longitudinally arranged angles being spot-welded to the lower inner edges of said side panels and transverse or zigzag-type being welded to said angles; the lower edge of said curved side panel being extended vertically downwards to create an apron that is embedded in the surface of said concrete building slab to form a positive moisture barrier.

26. The mould and chair combination of claim 1 in which the lower edge of a said mould side panel is turned through an angle of 90 degrees to create a lower transverse flange, tabs being spot-welded at their lower ends to said side panel at appropriate regular intervals, flats of a zigzag-type spacer abutting said side panel at the positions of said tabs being captured and fixed to said side panel by said tabs being bent downwardly and against said flats.

27. The mould and chair combination of claim 1 in which the lower edges of said mould side panels are double folded to form lower transverse flanges with short lengths of upstanding flange formed on their inner ends, the turned ends of transverse spacers or flats of zigzag-type spacers being made with short, inwardly projecting extensions formed on their lower edges, said lengths of upstanding flange being folded down to capture said short lateral extensions, thereby fixing said transverse or zigzag-type spacers to said side panels.

28. The mould and chair combination of claim 1 in which the lower edges of said mould side panels are turned inwardly through an angle of 90 degrees to create lower transverse flanges and the upper edges of said chair side panels are turned inwardly through an angle of 90 degrees to create attachment flanges, said mould being fixed to said chair by the abutting said lower transverse flange and attachment flange being clamped together by screw means or a plurality of suitably spaced clamps.

29. The mould and chair combination of claim 1 in which the lower and upper edges of said mould side panels are turned through two 90 degree folds to form lower and upper transverse flanges each having short upwardly or downwardly directed flanges formed on them, clips being folded over the turned ends of said transverse spacers or flats of said zigzag-type spacers at regular intervals with lateral extensions of said clips being positioned to abut said lower or upper transverse flanges, said clips then being captured by the folding inwardly of said upwardly or downwardly directed flanges, thereby maintaining said mould side panels in fixed spatial relationship.

30. The mould and chair combination of claim 1 in which a chair to support said mould comprises a base plate to which are fixed two, parallel, threaded supporting rods of suitable length orientated normal to said base plate, parallel slots being provided in said base plate to permit adjustment of the relative positions of said rods.

31. The mould and chair combination of claim 1 in which said mould is made with a lower transverse panel or said chair is made with a base plate, said transverse panel or said base plate having one or more slots through which extend fixing screws of one or more clamps, said clamps being adapted to engage reinforcing bar beneath said mould or said chair, tightening of a fixing screw in each said clamp simultaneously causing said clamp to grip said reinforcing bar and locking said clamp to said base plate, said slots permitting adjustment of the relative positions of said clamps.

32. The mould and chair combination of claim 1 in which said chair is made with a base plate provided with one or more slotted apertures, fixing screws passing through said apertures supporting spring clips adapted to engage and be frictionally attached to reinforcing bars beneath, tightening of said fixing screws fixing said clips to said base plate and, thereby, fixing said base plate to said reinforcing bars, said slotted apertures permitting positional adjustment of said clips in relation to said base plate.

33. The mould and chair combination of claim 1 in which said chair comprises a base plate to which are fixed two, parallel, threaded supporting rods of suitable length orientated normal to said base plate, suitable apertures being provided in said base plate to facilitate a flow of concrete there through, suitable fixing apertures being provided around the periphery of said base plate to permit the securing of said base plate to reinforcing bar beneath by wire ties.

34. The mould and chair combination of claim 1 in which said chair comprises a base plate and supporting rods, said rods being made plain and unthreaded with said mould secured in place on said rods by suitable clips frictionally attached to said rods above and below the appropriate surfaces of said mould.

35. The mould and chair combination of claim 1 in which said mould is supported upon a chair formed from a suitable length of metal section folded in a vertical plane, the cross-sectional shape of said folded metal section being selected to provide torsional, transverse and longitudinal stiffness and is optionally approximately Z-shaped, top hat-shaped, W-shaped or V-shaped with wide edge returns, said folded metal section being cut to length by shearing between two dies shaped to match said cross-sectional shape of said folded metal section.

36. The mould and chair combination of claim 35 in which said folded metal section is optionally cut straight across and welded to said mould or made with a plurality of attachment tabs formed on one or both ends, said attachment tabs being employed to fix the lower end of said chair to a base plate and/or its upper end to said mould, suitably positioned slots being punched in said base plate and/or said mould lower transverse panel, said attachment tabs being passed through said slots and bent over flat, twisted through an angle of approximately 90 degrees or welded to secure said folded metal section into place.

37. The mould and chair combination of claim 1 in which said chair comprises a folded metal section having telescopically adjustable side panels at its upper end, the lower end of said folded metal section being fixed to a base plate by a plurality of attachment tabs passed through suitable slots, said base plate being suitably joggled to accommodate said attachment tabs and fixed to said formwork by suitable fasteners, the upper ends of said side panels being turned through an angle of 90 degrees to create transverse fixing flanges, said mould being fixed to said chair by suitable fastenings passing through said mould transverse lower panel and said transverse fixing flanges; vertical slots being provided in said side panels or the sides of said folded metal section to permit sliding height adjustment of said mould when fastenings passing through said slots are loosened.

38. The mould and chair combination of claim 36 in which said attachment tabs are made in closely-spaced pairs and said folded metal section is fixed to said mould or said base-plate by passing a said pair of attachment tabs through a common slot and then bending them flat in opposed senses.

39. The mould and chair combination of claim 1 in which, where a void in a concrete slab may be tolerated, said chair is formed from a closed cross-sectional shape, for example, round, square, oval or triangular, all with plain, perforated or ribbed sides.

40. The mould and chair combination of claim 1 in which a sealing compound is applied to the inner surfaces of said mould, said sealing compound dispersing into the concrete with which said mould is filled.

41. The mould and chair combination of claim 40 in which said sealing compound takes the form of one in which reactive chemicals diffuse into concrete using water as a migrating medium and crystallize to form a non-soluble filling of pores and capillary tracts in the cured concrete, said sealing compound being applied in dry form with a suitable binder to the inner surfaces of said mould and activated by the filling of said mould with concrete.

42. The mould and chair combination of claim 1 in which, immediately following pouring of a building concrete slab upon which a sill or hob is to be formed, said mould is filled with concrete containing a waterproofing compound.

43. The mould and chair combination of claim 1 in which a clearly visible gauge mark is provided on the side panels of said chair or said mould up to which concrete is filled in the pouring or finishing of a building concrete slab.

44. The mould and chair combination of claim 1 in which said mould is made in a regularly or irregularly curved plan-form to meet the needs of a particular architectural situation, said side panels first being separately curved to the correct radii and then joined by transverse or zigzag-type spacers, said chairs being positioned as required to support said curved mould.

45. The mould and chair combination of claim 1 in which the materials used are any metal alloy or polymer.

46. The mould and chair combination of claim 1 in which component parts are joined using gas welding, electric welding, spot-welding, fusion, pressure welding, adhesives and any form of fastening well known in the art.

* * * * *